US011387565B2

(12) United States Patent
Pang et al.

(10) Patent No.: US 11,387,565 B2
(45) Date of Patent: Jul. 12, 2022

(54) ANTENNA AND METHODS OF FABRICATING THE ANTENNA AND A RESONATOR OF THE ANTENNA

(71) Applicant: City University of Hong Kong, Kowloon (HK)

(72) Inventors: Stella W. Pang, Kowloon (HK); Shuyan Zhu, Kowloon (HK); Yuanlong Li, Kowloon (HK); Kwai-Man Luk, Kowloon (HK)

(73) Assignee: City University of Hong Kong, Kowloon (HK)

( * ) Notice: Subject to any disclaimer, the term of this patent is extended or adjusted under 35 U.S.C. 154(b) by 92 days.

(21) Appl. No.: 16/829,547

(22) Filed: Mar. 25, 2020

(65) Prior Publication Data

US 2021/0305712 A1 Sep. 30, 2021

(51) Int. Cl.

| | |
|---|---|
| ***H01Q 15/16*** | (2006.01) |
| ***H01Q 5/45*** | (2015.01) |
| ***H01Q 19/02*** | (2006.01) |

(52) U.S. Cl.

CPC ..... *H01Q 15/16* (2013.01); *H01Q 5/45* (2015.01); *H01Q 19/025* (2013.01)

(58) Field of Classification Search

CPC ..... H01Q 19/108; H01Q 19/13; H01Q 19/18; H01Q 13/10; H01Q 13/18

See application file for complete search history.

(56) References Cited

U.S. PATENT DOCUMENTS

| | | | | |
|---|---|---|---|---|
| 2018/0013205 | A1* | 1/2018 | Rosenauer | H01Q 1/2283 |
| 2019/0221939 | A1* | 7/2019 | George | H01Q 9/0485 |
| 2021/0066811 | A1* | 3/2021 | Tsuruda | H01L 29/20 |

* cited by examiner

*Primary Examiner* — Daniel Munoz

(74) *Attorney, Agent, or Firm* — Renner Kenner Greive Bobak Taylor & Weber

(57) ABSTRACT

An antenna and methods of fabricating the antenna and a resonator of the antenna. The antenna includes an antenna feed arranged to emit an electromagnetic signal along a predetermined direction; a resonator disposed adjacent to the antenna feed arranged to improve a directivity of the electromagnetic signal being emitted by the antenna feed; wherein the resonator includes a first reflector and a second reflector sandwiching a resonating cavity therebetween; and wherein the first reflector includes a curved reflector surface.

38 Claims, 21 Drawing Sheets
(1 of 21 Drawing Sheet(s) Filed in Color)

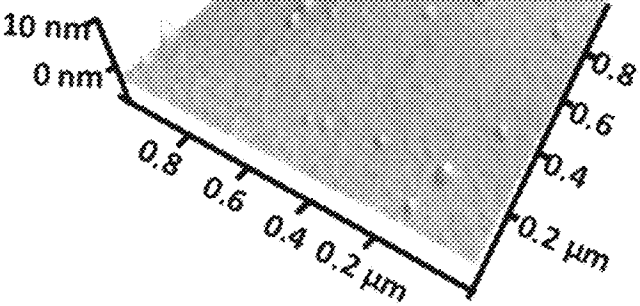
Root mean square (RMS) = 0.29 nm
FIG. 18A
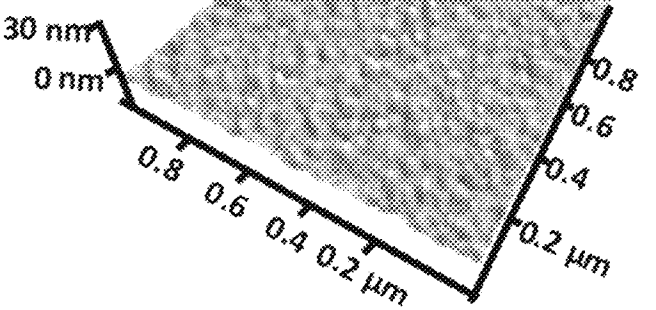
RMS = 1.20 nm
FIG. 18B
RMS = 0.35 nm
FIG. 18C
RMS = 1.94 nm
FIG. 18D

100

1900

ANTENNA AND METHODS OF FABRICATING THE ANTENNA AND A RESONATOR OF THE ANTENNA

TECHNICAL FIELD

The present invention relates to an antenna and methods of fabricating the antenna and a resonator of the antenna, particularly, although not exclusively, to a high-gain and low-profile Gaussian beam antenna for THz applications.

BACKGROUND

In a radio signal communication system, information is transformed to radio signal for transmitting in form of an electromagnetic wave or radiation. These electromagnetic signals are further transmitted and/or received by suitable antennas.

Unidirectional antennas may be used when there is a need to concentrate radiation in a desired direction. In some example antennas, resonating cavities may be included to improve the output gain of the antennas, which may result in an increase of size of the antenna structure. It is desirable to reduce the size of the antenna so as to include the antenna in a more compact device and to reduce the visibility of the antenna.

SUMMARY OF THE INVENTION

In accordance with a first aspect of the present invention, there is provided an antenna comprising: an antenna feed arranged to emit an electromagnetic signal along a predetermined direction; a resonator disposed adjacent to the antenna feed arranged to improve a directivity of the electromagnetic signal being emitted by the antenna feed; wherein the resonator includes a first reflector and a second reflector sandwiching a resonating cavity therebetween; and wherein the first reflector includes a curved reflector surface.

In an embodiment of the first aspect, the antenna feed is positioned at a center position of the curved reflector surface.

In an embodiment of the first aspect, the first reflector is defined with an aperture at the center position of the curved reflector surface so as to expose the antenna feed to the resonating cavity.

In an embodiment of the first aspect, the first reflector includes a layer reflective material on the curved reflector surface.

In an embodiment of the first aspect, the reflective material includes Ti, Cu, Au and/or other metals.

In an embodiment of the first aspect, the curved reflector surface is formed on a concave pattern defined on a layer of soft material, such as polymer.

In an embodiment of the first aspect, the concave pattern is formed by an imprinting process or other patterning technologies.

In an embodiment of the first aspect, the concave pattern is formed by imprinting with a circular mold, such as a glass bead, on the layer of polymer deposited on a substrate of the first reflector.

In an embodiment of the first aspect, the soft material includes polymer, such as SU-8.

In an embodiment of the first aspect, the second reflector includes a partial reflected surface.

In an embodiment of the first aspect, the second reflector includes a membrane, such as a silicon membrane.

In an embodiment of the first aspect, the membrane includes a thickness of 20 μm.

In an embodiment of the first aspect, the resonator further includes a holder structure disposed adjacent to the curved reflector surface of the first reflector, and the holder structure supports the second reflector opposite to the first reflector.

In an embodiment of the first aspect, the second reflector, the holder structure and/or the resonating cavity are cylindrical in shape.

In an embodiment of the first aspect, the holder structure is formed by 3D printing or other machining technology.

In an embodiment of the first aspect, the resonator is further arranged to support high order Laguerre-Gaussian beam modes of the electromagnetic signal.

In an embodiment of the first aspect, the antenna feed includes a magneto-electric dipole.

In an embodiment of the first aspect, the antenna feed is a metalized structure.

In an embodiment of the first aspect, the antenna feed includes a slot and a plurality of pillar structures formed on a substrate, such as a silicon substrate.

In an embodiment of the first aspect, the silicon substrate is coated with a layer of metal include at least one of Ti, Cu and/or Au.

In an embodiment of the first aspect, the antenna is operable as a Gaussian beam antenna (GBA).

In an embodiment of the first aspect, a combination of the antenna feed and the resonator includes a thickness smaller than three times of a wavelength of the electromagnetic signal emitted by the antenna feed.

In accordance with a second aspect of the present invention, there is provided a method of fabricating a resonator for an antenna, comprising the steps of: fabricating a first reflector including a curved reflector surface; disposing a holder structure adjacent to the curved reflector surface; and disposing a second reflector on the holder structure opposite to the first reflector; wherein the first reflector and the second reflector sandwiches a resonating cavity therebetween; and wherein the resonator is arranged to improve a directivity of the electromagnetic signal being emitted by an antenna feed of the antenna including the resonator.

In an embodiment of the second aspect, the step of fabricating the first reflector comprises the step of imprinting with a circular mold, such as a glass bead, on a layer of soft material (such as polymer) deposited on a substrate of the first reflector.

In an embodiment of the second aspect, in the imprinting process, the circular mold is imprinted on the layer of soft material deposited on the substrate at low temperature and pressure for a predetermined period of time, and followed by curing of the soft material to form the curved reflector surface.

In an embodiment of the second aspect, the step of imprinting with a circular mold on the layer of soft material deposited on the substrate of the first reflector comprises the step of reducing a surface energy of the circular mold by coating the circular mold with trichloro(1H, 1H, 1H, 1H-perfluorooctyil)silane and/or other chemicals to modify surface energy.

In an embodiment of the second aspect, the step of fabricating the first reflector comprises the step of coating the curved reflector surface with a layer reflective material.

In an embodiment of the second aspect, the reflective material includes Ti, Cu and/or Au.

In an embodiment of the second aspect, the step of fabricating the first reflector comprises the step of defining an aperture at a center position of the curved reflector surface so as to expose the antenna feed to the resonating cavity.

In an embodiment of the second aspect, the step of defining an aperture at the center position of the curved reflector surface comprises the step of cutting through the layer of soft material to form the aperture on the first reflector.

In an embodiment of the second aspect, the antenna feed is positioned at the center position of the curved reflector surface.

In an embodiment of the second aspect, the method further comprises the step of fabricating the holder structure using 3D printing or other machining technologies.

In an embodiment of the second aspect, the disposing a second reflector on the holder structure comprising the step of adhering a membrane on the holder.

In accordance with a third aspect of the present invention, there is provided a method of fabricating an antenna, comprising the steps of: fabricating an antenna feed on a substrate; and combining the antenna feed with at least a part of the resonator fabricated using the method in accordance with the second aspect; wherein the resonator is disposed adjacent to the antenna feed.

In accordance with a third aspect of the present invention, the substrate is a silicon substrate.

In an embodiment of the second aspect, the step of fabricating the antenna feed comprises the step of etching the substrate to define a slot and a plurality of pillar structures on the substrate.

In an embodiment of the second aspect, the silicon substrate is processed by deep reactive ion etching.

In an embodiment of the second aspect, the method further comprises the step of coating the silicon substrate with a layer of metal include at least one of Ti, Cu and Au.

In an embodiment of the second aspect, the antenna feed is combined with the first reflector of the resonator.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Embodiments of the present invention will now be described, by way of example, with reference to the accompanying drawings in which:

FIGS. 18A to 18D are atomic force microscopy of Si, Ti/Cu/Au on Si, SU-8 on Si and Ti/Cu/Au on SU-8 surfaces, respectively;

DETAILED DESCRIPTION OF THE PREFERRED EMBODIMENT

The inventors have, through their own research, trials and experiments, devised that, terahertz (THz) technology is a possible solution for 6G communication systems with terabit-per-second (Tb/s) data rate. However, the transmission distance of THz electromagnetic wave may be limited due to the low power and high propagating loss of THz source.

Therefore, antenna with high gain is necessary for THz communication system. In some example antennas, such as horn, lens and microfabricated cavity antennas may work at a frequency over 1 THz, however they are often bulky or have low gain. In practical usage environment, a high gain and low-profile THz antenna may be necessary for transmitting and receiving signals for THz communications.

The inventors devised that millimeter and micrometer wave antennas may be fabricated using manufacturing technologies such as metal milling, electroplating, and stacked printed circuit board, however these techniques are not applicable to be used for fabricating THz antennas at microscale.

In a preferred embodiment of the present invention, an imprint technology in silicon (Si) is applied to fabricate a high gain and low-profile THz Gaussian beam antenna (GBA). Preferably, the THz GBA consists of metalized Si magneto-electric (ME) dipole as antenna feed, metalized spherical concave cavity structure and partially reflective surface (PRS) as open resonator cavity.

Figure 1:
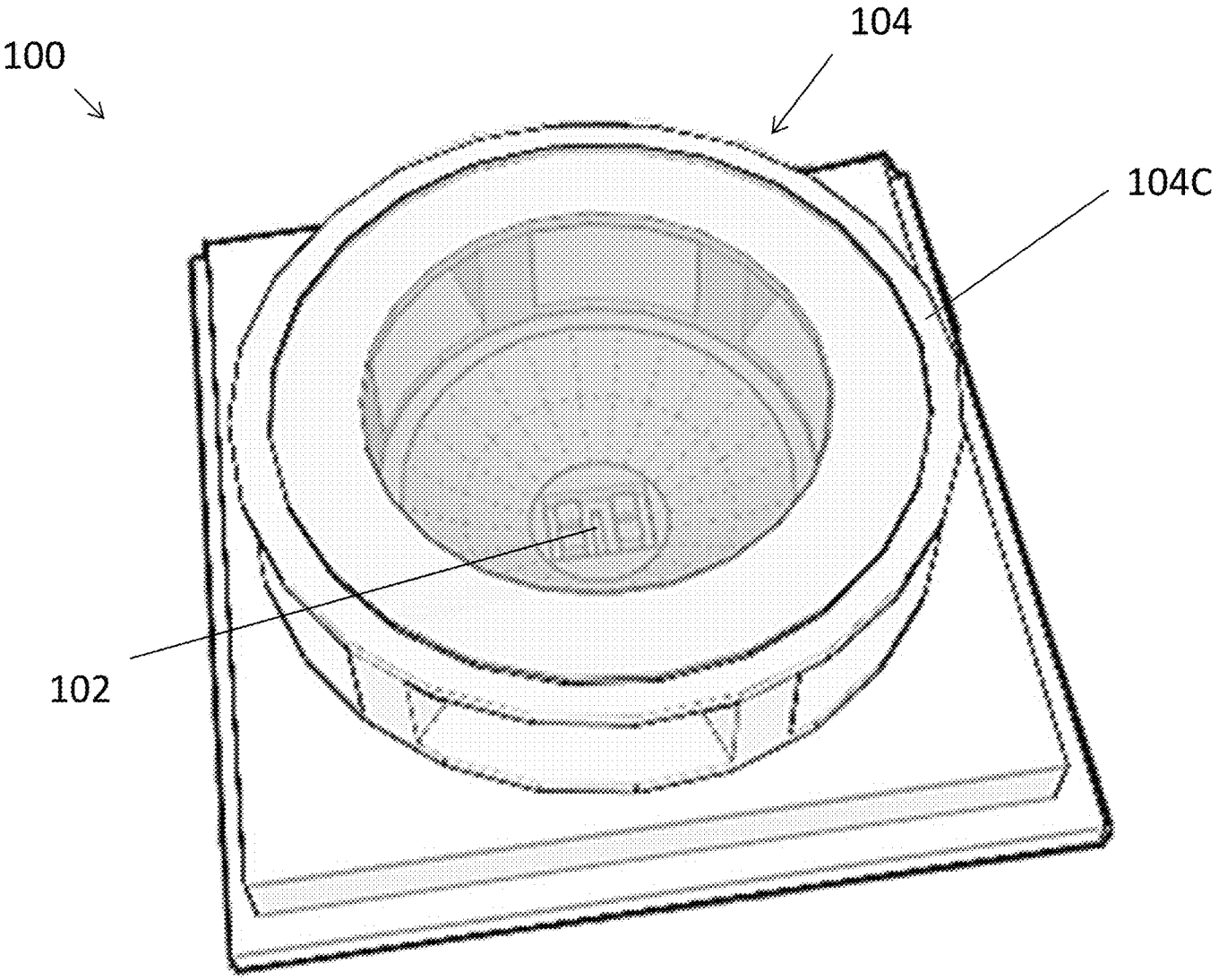
FIG. 1 is a perspective view of an antenna in accordance with embodiments of the present invention.

With reference to FIG. 1, there is shown an embodiment of an antenna 100 comprising an antenna feed 102 attached to a resonator 104. In this example, the antenna feed 102 is arranged to emit an electromagnetic signal along a predetermined direction, e.g. along a normal direction with respect to the planar structure of the antenna 100. The signal direction, or a directivity of the electromagnetic signal being emitted by the antenna feed 102 may be improved by resonating the signal using the resonator 104 disposed adjacent to the antenna feed 102.

The resonator 104 is generally defined by the first and second reflectors (104A, 104B) sandwiching a resonating cavity 106, in which the first and second reflectors 104A/B are separated by a holder structure 104C surrounding the resonating cavity 106, and the distance therebetween is defined by the height/thickness of the holder structure 104C. Preferably, the resonator 104 has a substantially cylindrical profile, i.e. the first/second reflector 104A/B, the holder structure 104C and/or the resonating cavity 106 are cylindrical in shape.

For easy reference only, the first and the second reflectors may be referred as bottom and top reflectors positioned at the bottom and the top of the resonator cavity in FIG. 1. However, a person skilled in the art should appreciate that the oppositely arranged reflectors may be placed in to other alternative orientations.

In a preferable embodiment, the first reflector 104A includes a curved reflector surface, which may further improve the directivity of the electromagnetic signal being emitted by the antenna feed 102, e.g. when compared to planar reflector surface. Detail operation of this structure in a preferred embodiment will be further explained later in this disclosure.

Preferably, the curved reflector surface is formed on a concave pattern defined on a layer of soft material, such as SU-8, which may be easily patterned by using imprinting. Alternatively, other polymer or material may be used to form the concave reflective surface as require using different fabrication technologies.

In addition, the first reflector 104A includes a reflecting coating on the curved reflector surface, for reflecting the partially reflected signal back to the top of the antenna. Preferably, 10/500/20 nm of titanium (Ti)/copper (Cu)/gold (Au) may be deposited on the SU-8 layer, in which Ti may improve the adhesion of the entire metal layer on the polymer, and the topmost Au layer may prevent the middle Cu layer from being oxidized.

The second reflector 104B on the opposite side includes a partially reflected surface (PRS). During an operation of the antenna, electromagnetic (EM) signal/energy is partially reflected towards the first reflector surface 104A, while allowing a portion of the energy to pass through. Thus, an open resonator cavity 106 is formed which supports high order Laguerre-Gaussian beam modes in the emitted EM signal.

Preferably, the second reflector 104B includes a silicon membrane, and the silicon membrane may be of undoped silicon with a thickness of 20 μm in one preferred embodiment.

Advantageously, in one preferred embodiment of the invention, the open resonator cavity defined by the metalized SU-8 spherical concave cavity and PRS Si membrane was found to result a more uniform phase distribution with high directivity, compared to Fabry-Perot cavity antenna with two flat mirrors.

In this example, the antenna feed 102 includes a magneto-electric (ME) dipole, which may be fabricated on a silicon substrate, preferably a double-side polished silicon wafer. On the silicon substrate, a slot 102A and a plurality of pillar structures 102B, such as square pillars, may be defined to form the ME dipole. In addition, the substrate with the defined feed structures may be metalized such that it may operate to emit an EM signal as desired.

Figure 2B:
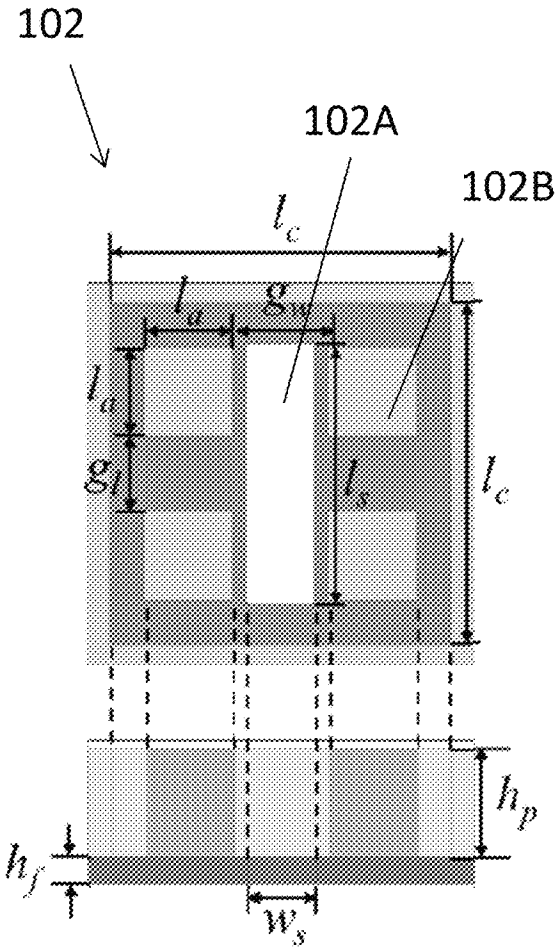
FIG. 2B is a top view and a cross-sectional view of the antenna feed of the antenna of FIG. 1.
Figure 2A:
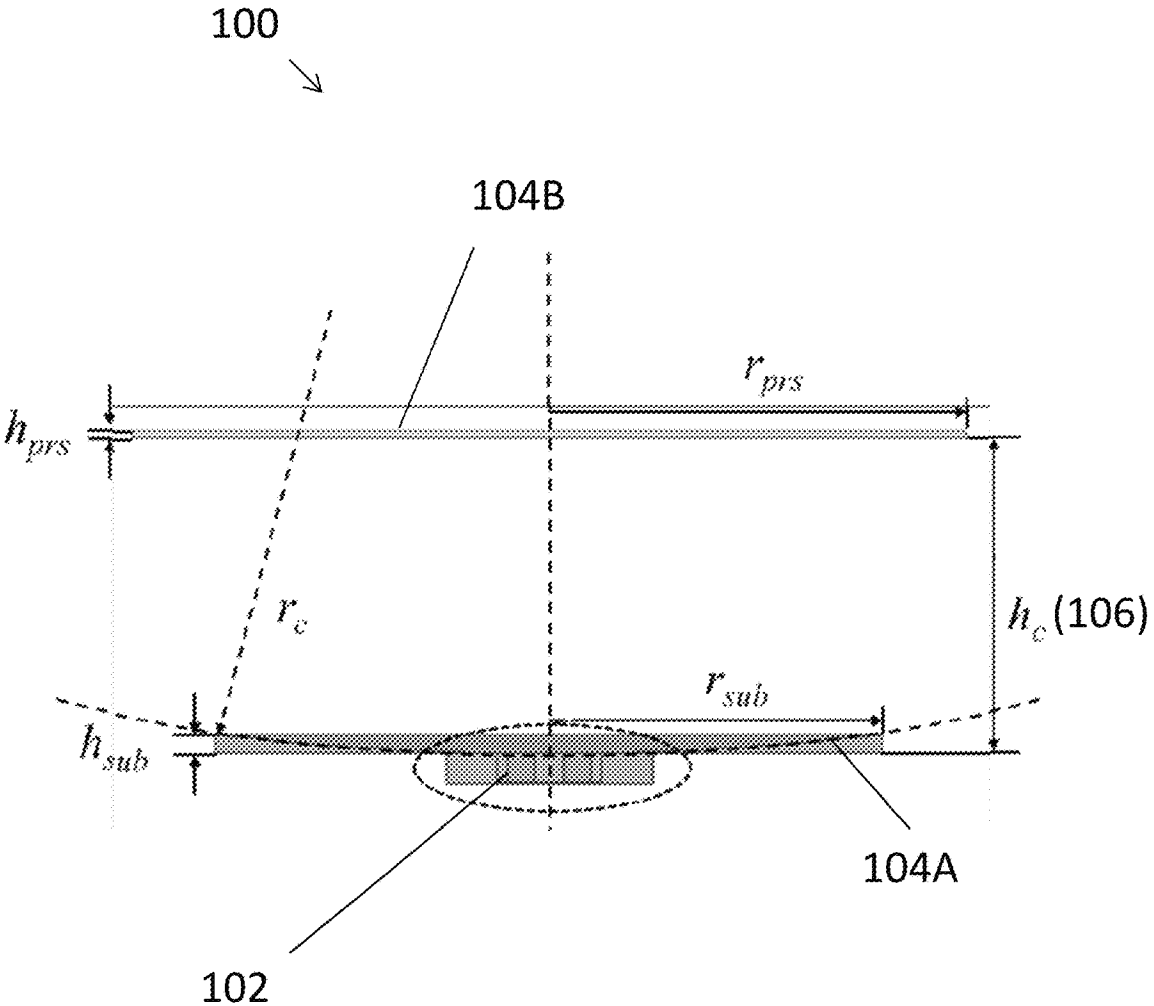
FIG. 2A is a cross-sectional view of the antenna of FIG. 1.

With reference to FIGS. 2A and 2B, components the antenna may include different design parameters. The following table lists out the parameters of the antenna in accordance with a preferred embodiment of the present invention. This GBA was designed to work over 1 THz.

| Parameter | $h_c$ | $h_{sub}$ | $h_{prs}$ | $r_c$ | $r_{sub}$ | $r_{prs}$ | $l_c$ |
|---|---|---|---|---|---|---|---|
| Value (μm) | 750 | 45 | 20 | 7000 | 800 | 1500 | 250 |
| Parameter | $l_a$ | $l_s$ | $w_s$ | $g_l$ | $g_w$ | $h_f$ | $h_p$ |
| Value (μm) | 65 | 190 | 50 | 55 | 70 | 20 | 80 |

Preferably, the antenna, i.e. a combination of the antenna feed 102 and the resonator 104, includes a thickness smaller than three times of a wavelength of the electromagnetic signal emitted by the antenna feed. A low profile (smaller than three wavelengths) of an antenna may facilitate easier integration as compact device.

As appreciated by a skilled person, one of more of these parameters may be modified such that the antenna may operate with other frequencies. For example, the height of the resonating cavity $h_c$ may be changed to other value to support another resonating frequency, and the excitation frequency may be altered by modifying one or more of the parameters in the antenna feed structure as shown in FIG. 2B.

Figure 3:
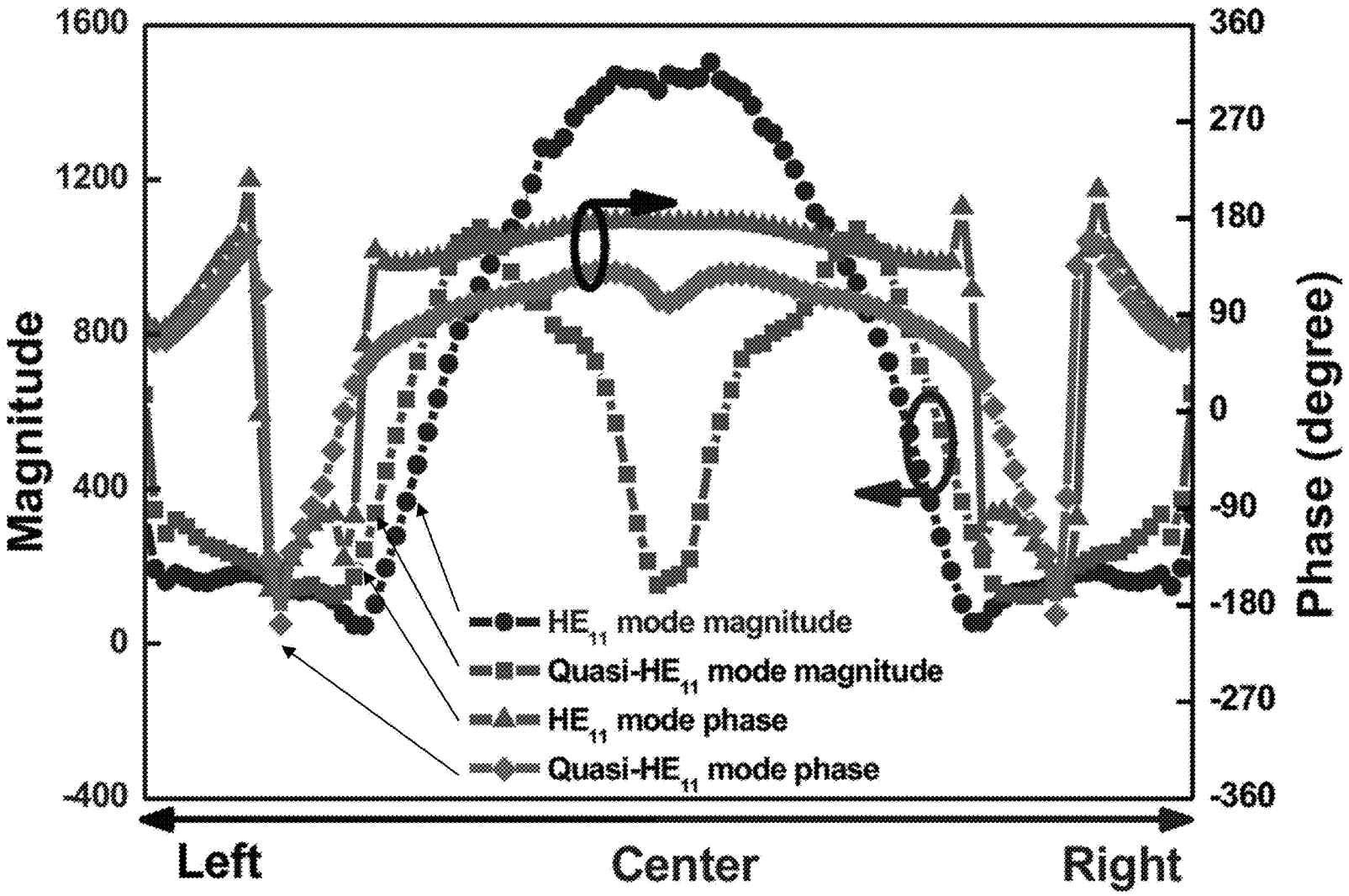
FIG. 3 is a plot showing E-field magnitude and phase distributions of $HE_{11}$ mode and quasi-$HE_{11}$ mode along aperture diameter in the antenna of FIG. 1.

The inventors carried out a number of experiments to test the preferred embodiment of the antenna 100 (or the THz GBA) including the abovementioned design parameters. With reference to FIG. 3, it can be observed that the THz GBA changed the fundamental $HE_{11}$ mode to a quasi-$HE_{11}$ mode because the flat conductor superstrate of Fabry-Perot cavity was replaced by a PRS, which resulted edge radiation due to the practical use of finite surfaces.

Figure 4:
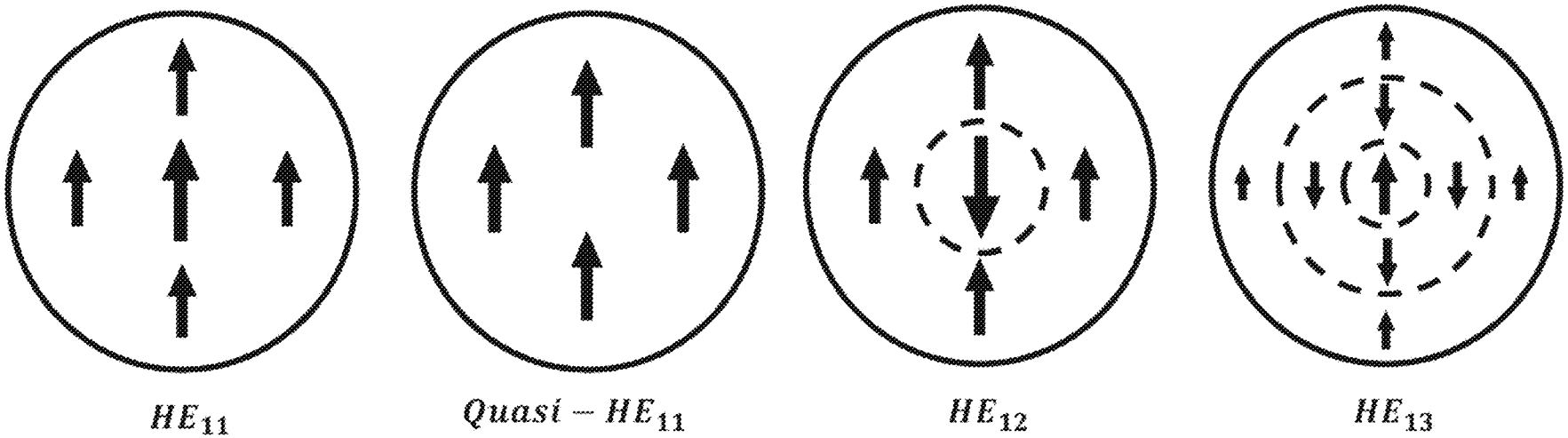
FIG. 4 is an illustration showing patterns of $HE_{1,p+1}$ modes in the aperture of the antenna of FIG. 1.

Preferably, the fifth-order cavity was chosen for THz GBA and the height of open resonator cavity was set to be five halves of a free-space wavelength. Referring to FIG. 4, there is shown the E-field distributions of different $HE_{1,p+1}$ modes of the EM signal emitted by the THz GBA in accordance with embodiments of the present invention. It was observed that the resonant frequencies of the $HE_{11}$, $HE_{12}$, and $HE_{13}$ modes were 1.02, 1.06, and 1.1 THz, respectively.

Preferably, the THz GBA chosen quasi-$HE_{11}$ and $HE_{12}$ modes to trade off the wide bandwidth against the relatively high gain and low side lobe level (SLL).

Figure 5B:
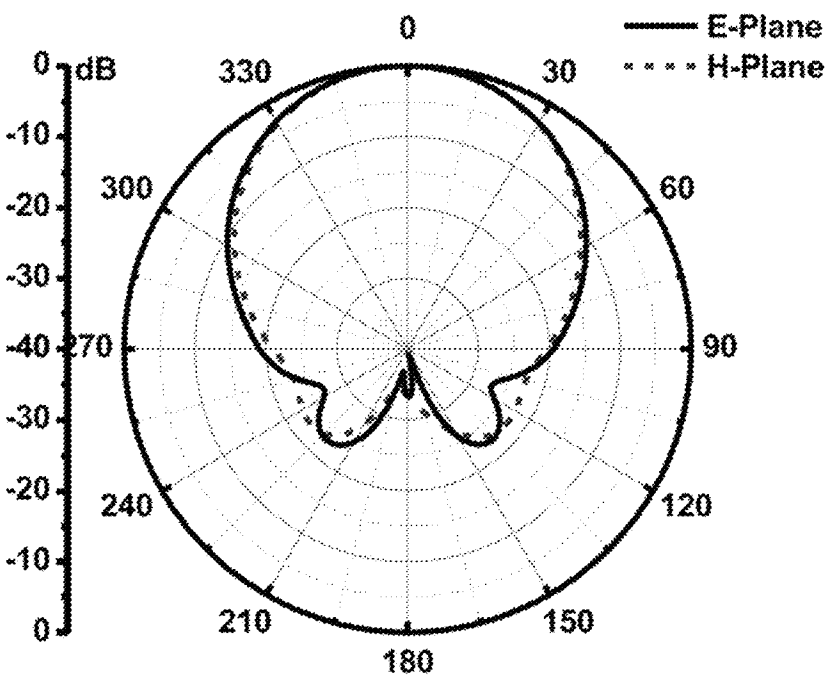
FIGS. 5A and 5B are simulated radiation pattern of waveguide WR-1.0 and ME dipole at 1 THz, respectively.
Figure 5A:
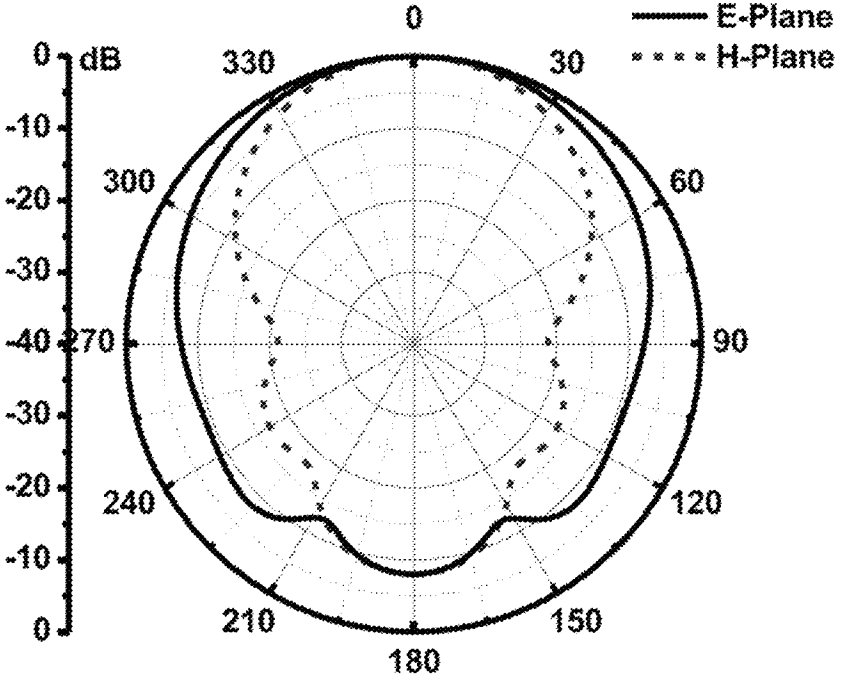

Referring to FIGS. 5A and 5B, the ME dipole was used to reduce the difference in E-plane and H-plane of radiation pattern. In this example, the commonly used waveguide WR-1.0 (FIG. 5A) was simulated as reference.

Figure 6:
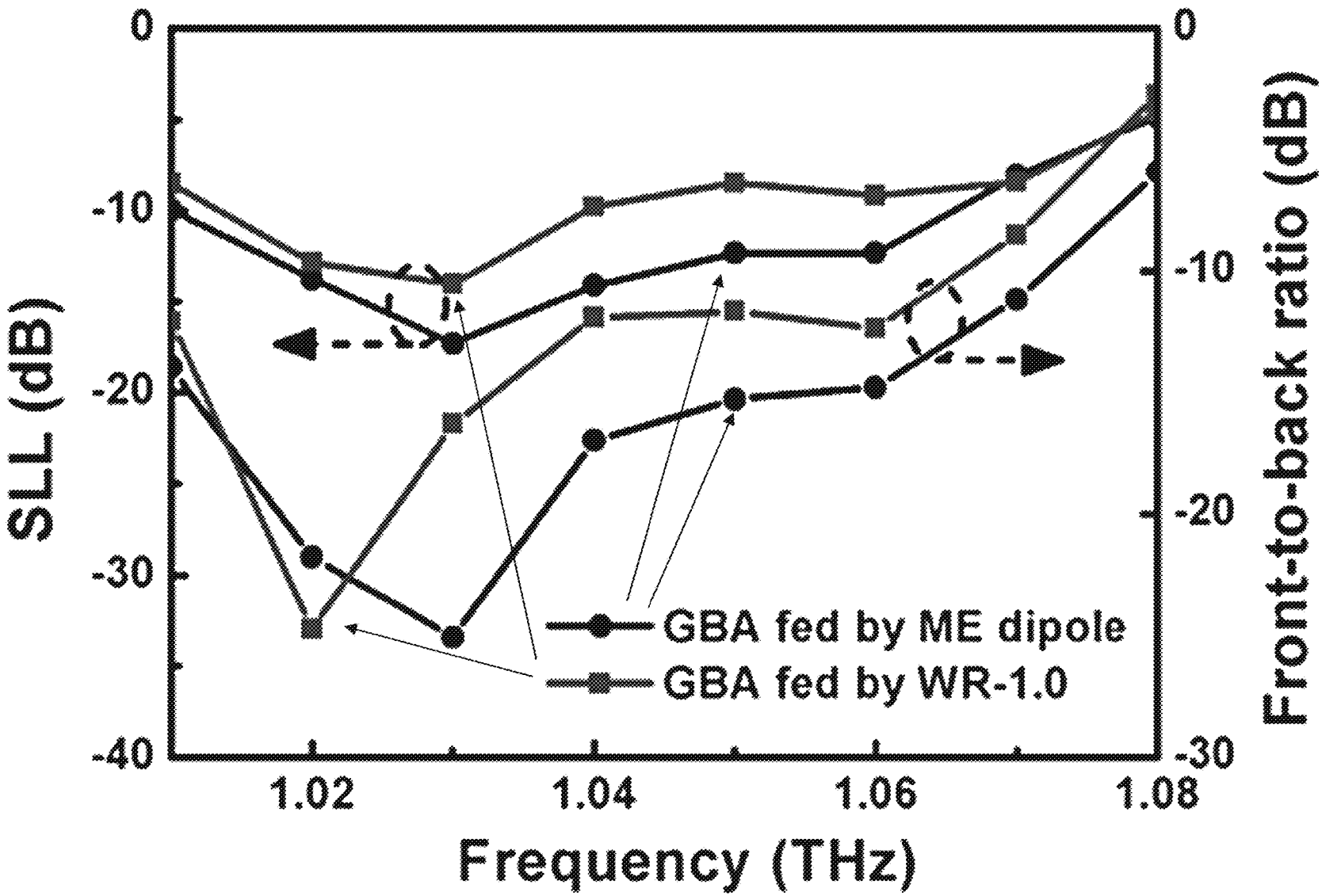
FIG. 6 is a plot showing SLL and front-to-back comparison between the THz GBA fed by WR-1.0 waveguide and ME dipole of the antenna of FIG. 1.
Figure 7:
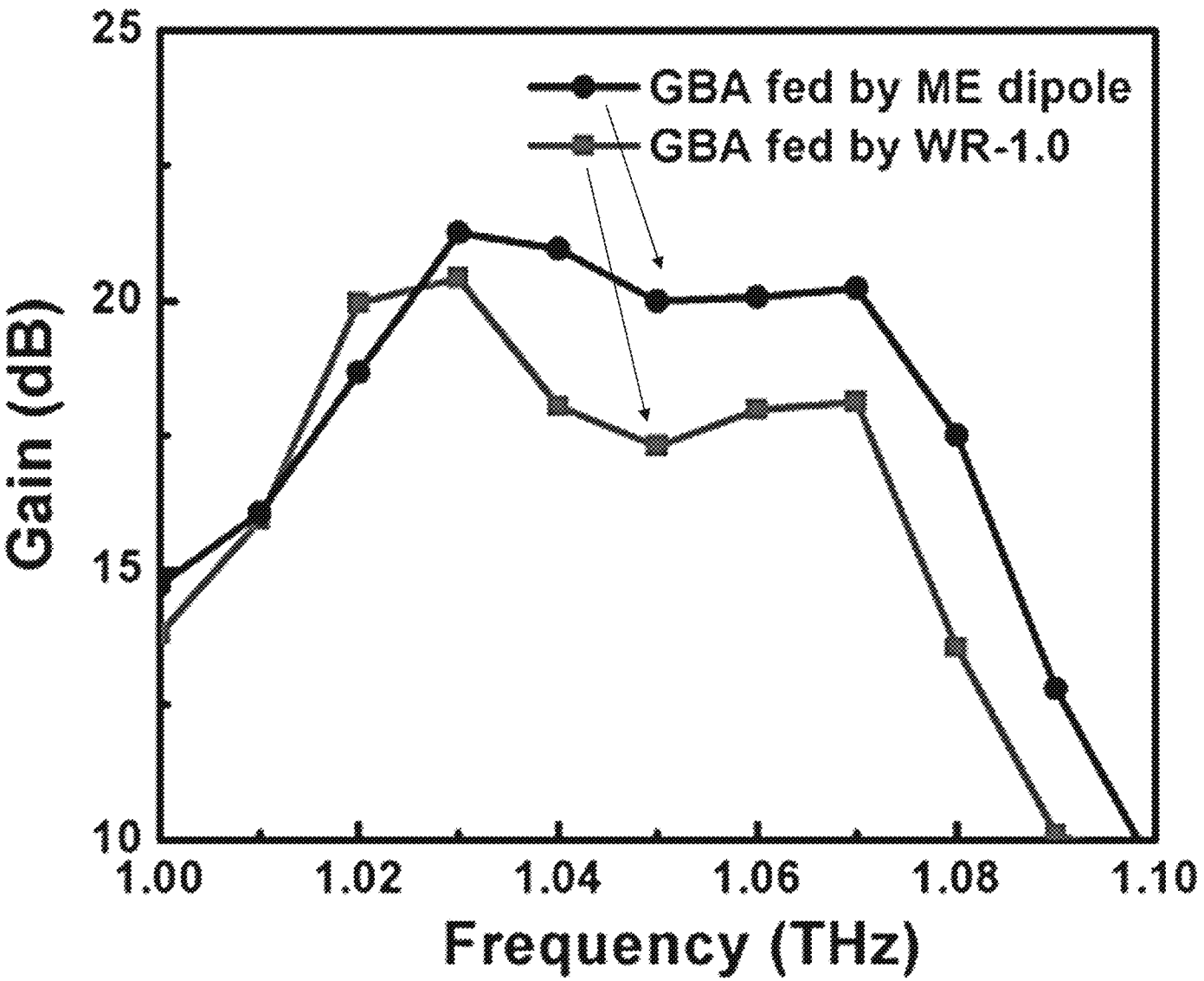
FIG. 7 is a plot showing simulated gain between the THz GBA fed by WR-1.0 waveguide and ME dipole of the antenna of FIG. 1.

Also with reference to FIG. 6, the THz GBA fed by ME dipole was designed to decrease the SLL and front-to-back ratio. In addition, referring to FIG. 7, the THz GBA fed by ME dipole was designed to increase the gain.

Figure 8B:
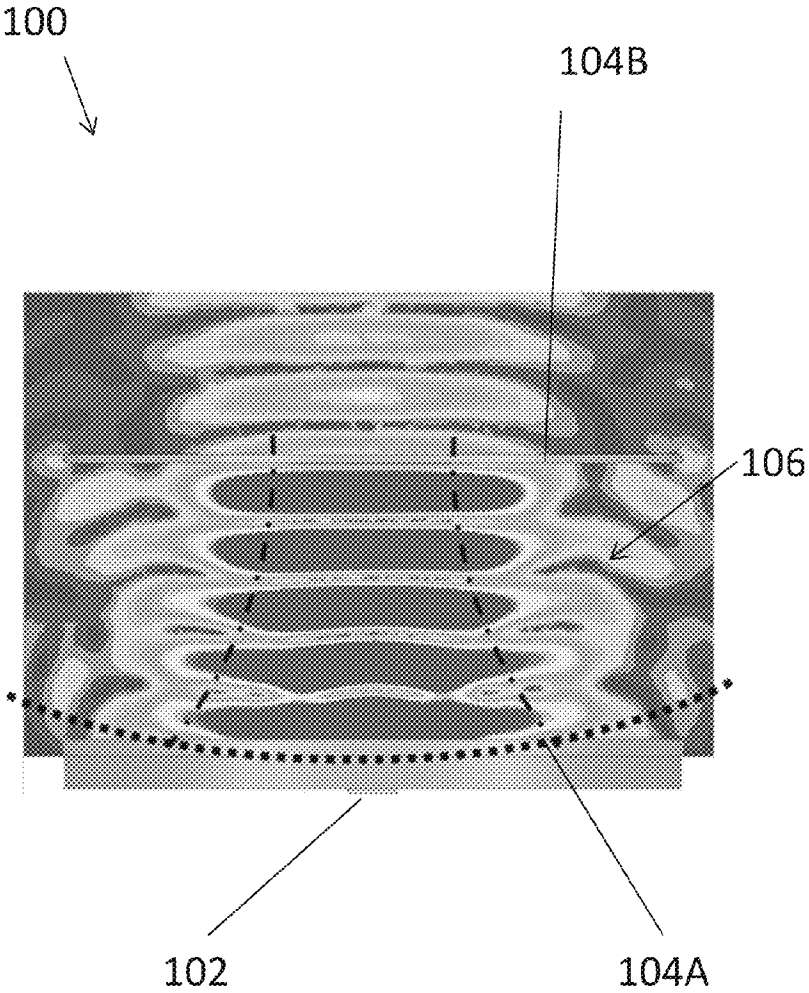
FIGS. 8A and 8B are color distribution plots showing E-field magnitude distribution in resonator cavities with flat reflective surface, and with curved reflective surface respectively.
Figure 8A:
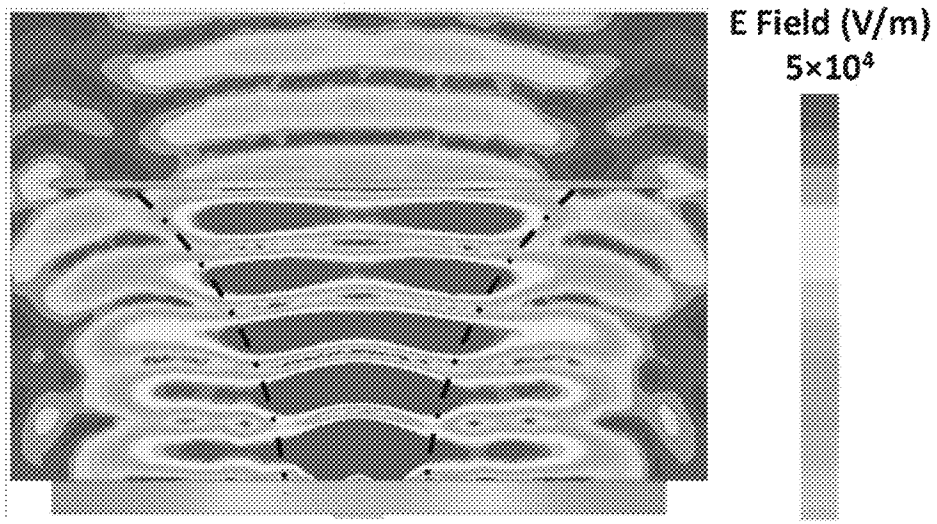

In a simulation experiment, referring to FIGS. 8A and 8B, the performance of THz GBA 100 was simulated by full-wave electromagnetic simulation software ANSYS HFSS. Compared to Fabry-Perot cavity with two flat mirrors as shown in FIG. 8A, the phase distribution of GBA with spherical concave cavity as shown in FIG. 8B was more uniform due to less edge radiation. The radiated wave of THz GBA was similar to a plane wave, indicating that its directivity was higher than the flat reflective mirror.

Figure 9:
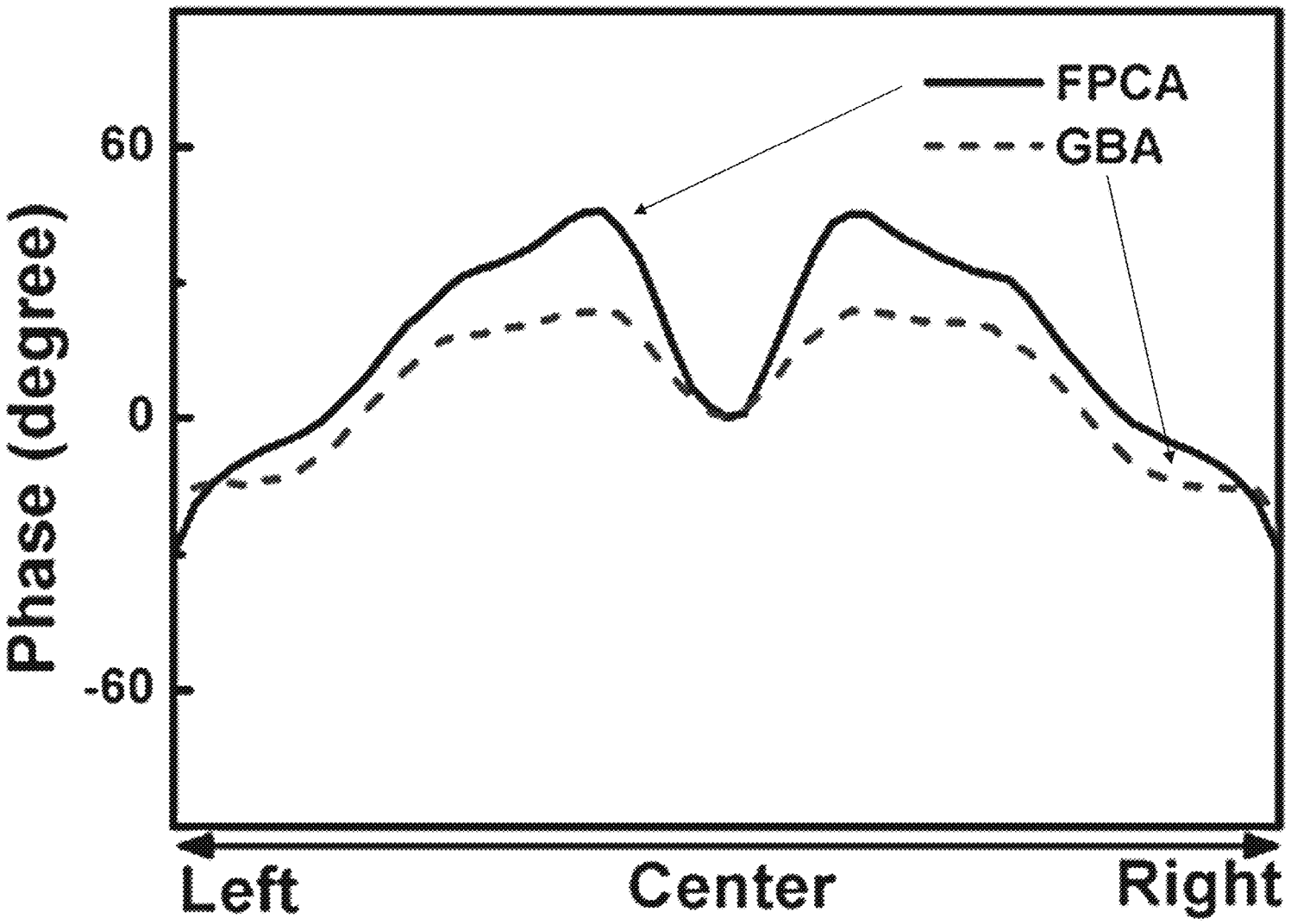
FIG. 9 is a plot showing E-field phase distribution along aperture diameter for Fabry-Perot cavity antenna and GBA of FIG. 1.

In addition, referring to FIG. 9, the THz GBA including the spherical concave cavity as reflective mirror may correct the E-field phase across the aperture and improve the directivity.

Figure 10:
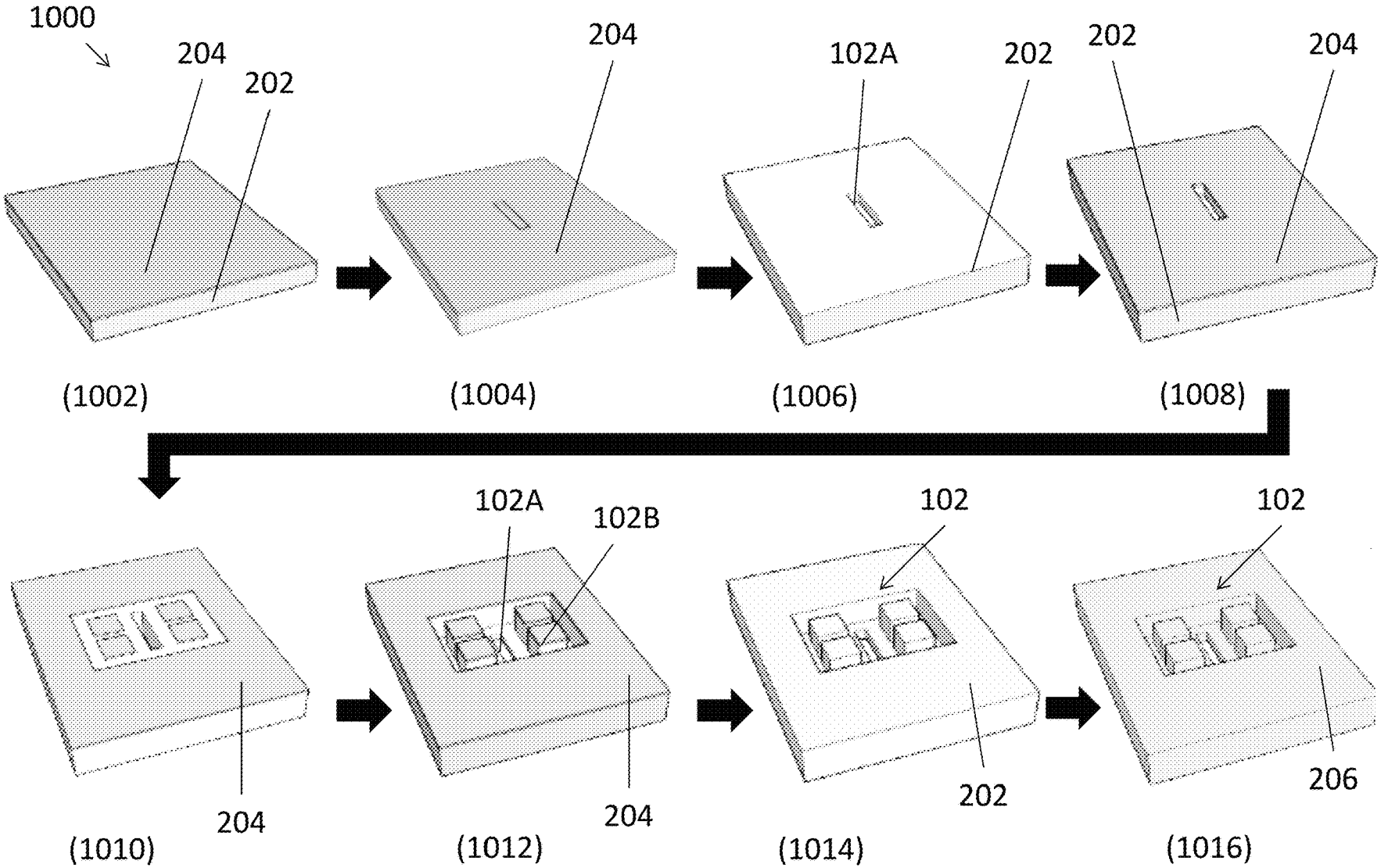
FIGS. 10 are 11 are process flow diagrams showing a method for fabricating an antenna feed and the resonator of the antenna, in accordance with embodiments of the present invention.
Figure 11:
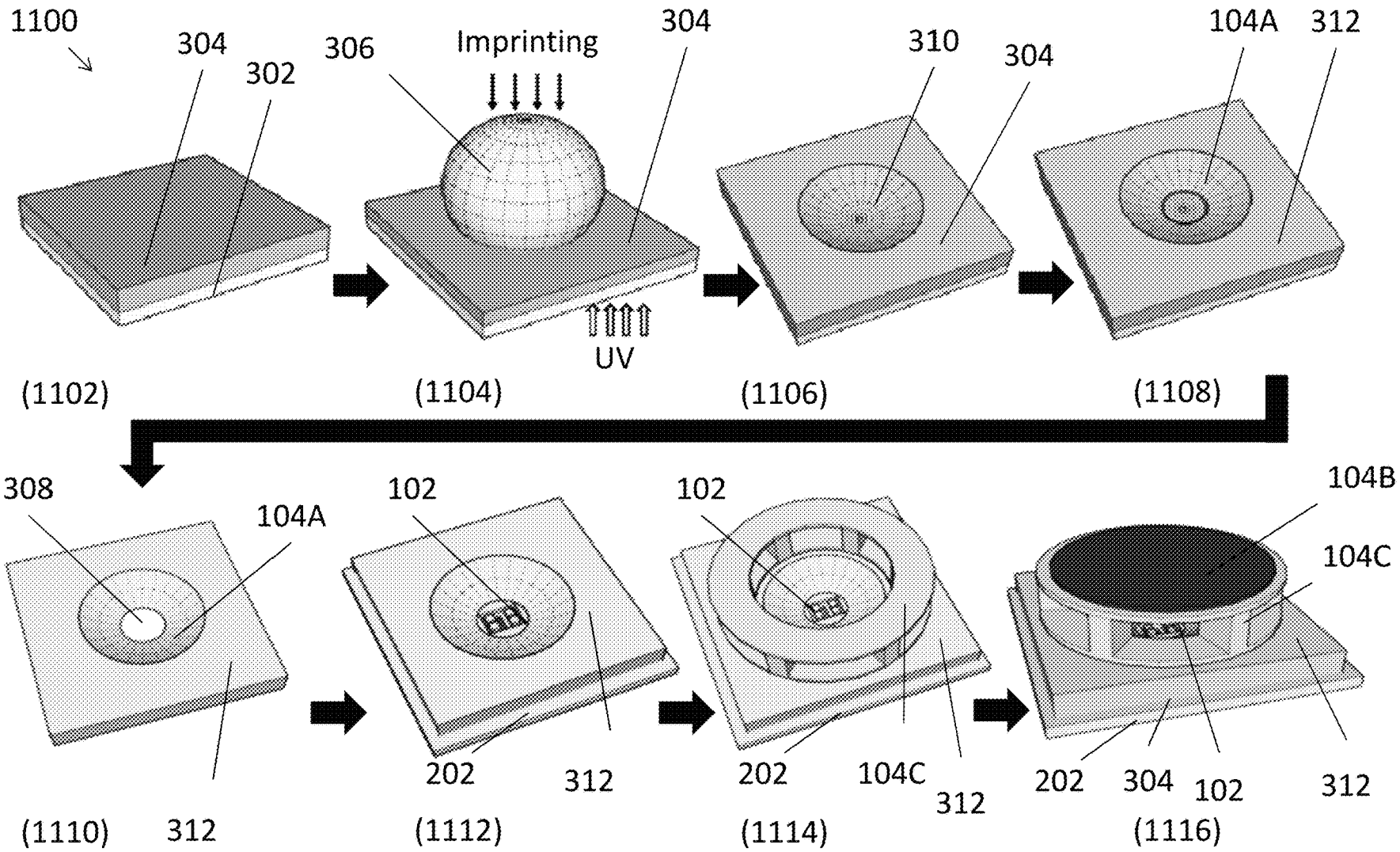

With reference to FIGS. 10 and 11, there is shown embodiments of fabrication process of the antenna 100. The method 1000 comprises the steps of fabricating an antenna feed 102 on a silicon substrate, and then the antenna feed 102 may be combined with the resonator 104 being fabricated using the method 1100.

Referring to FIG. 10, the fabrication process start with fabricating the metalized Si antenna feed with ME dipole using photolithography and reactive ion etching (RIE) to define a slot 102A and a plurality of pillar structures 102B on the silicon substrate. At step 1002, a silicon substrate 202, such as a 100 μm thick double-side polished silicon wafer, is provided, and preferably cleaned using standard cleaning procedures. Then a layer of photoresist 204 with 5 μm thickness may be first coated on 100 μm thick Si substrate.

At step 1004, a slot pattern with 50 μm width and 190 μm length may be patterned by optical lithography. The photoresist 204 with slot pattern may be used as mask to etch through the Si substrate using dry etching, preferably with a deep reactive ion etching (DRIE) Bosch process, by switching between a passivation cycle of 85 sccm $C_4F_8$, 600 W coil power, and 16 mTorr for 5 s and an etch cycle of 120/13 sccm $SF_6/O_2$, 600 W coil power, 14 W platen power, and 30 mTorr for 8 s for 175 cycles, followed by stripping the photoresist from the substrate at step 1006.

Figure 12B:
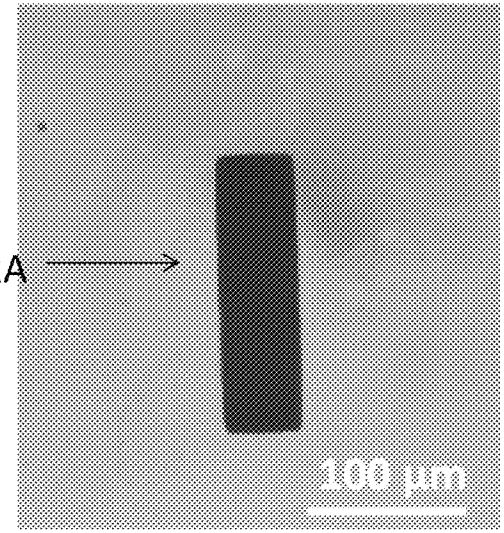
FIGS. 12A and 12B are microscopic images showing a top side and a back side of Si slot of the antenna feed fabricated on a silicon substrate.
Figure 12A:
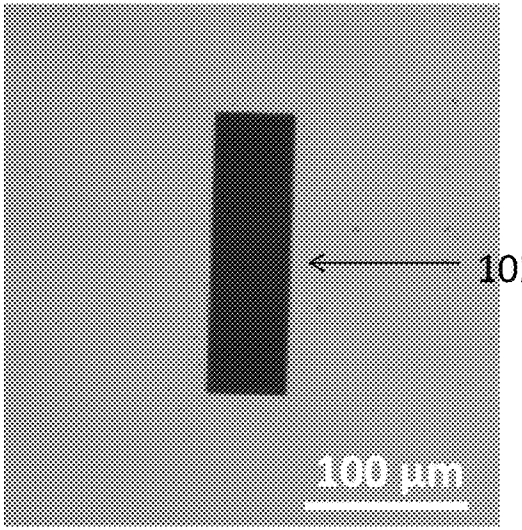

As shown in FIGS. 12A and 12B, both the front side and the back side of the Si slot 102A are substantially the same with 50 μm width and 190 μm length, which confirms that the 100 μm thick silicon substrate 202 was dry etched through vertically using the DRIE process.

Subsequently, at step 1008, another layer of photoresist 204 with 2 μm thick may be coated on the Si substrate 202 defined with etched-through slot pattern 102A. Four 60 μm length square patterns may be aligned with respect to the slot pattern 102A on the Si substrate 202, and defined using optical lithography at step 1010. After lithography, at step 1012, 80 μm thick Si pillars 102B may be form by using the similar DRIE Bosch process for 140 cycles, followed by stripping the photoresist from the substrate 202 at step 1012 to form the Si antenna feed 102 with ME dipole.

Figure 13B:
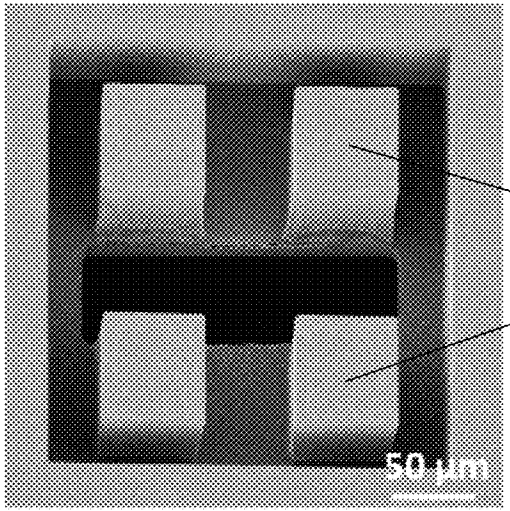
FIGS. 13A and 13B are microscopic images showing a top view and a tilted view of metallized Si THz antenna feed fabricated on a silicon substrate.
Figure 13A:
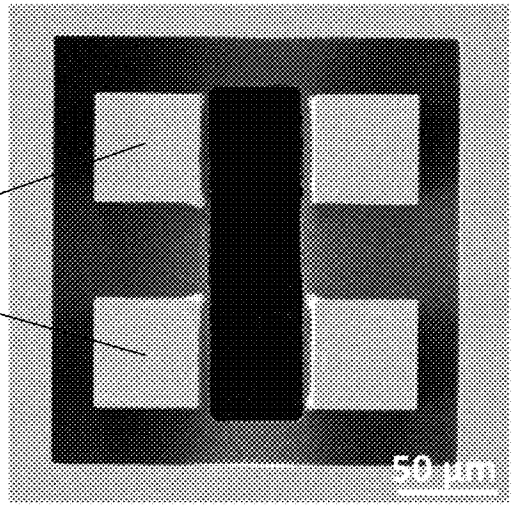

As shown in FIGS. 13A and 13B, the Si antenna feed 102 with ME dipole was generated by patterning four pillar-shaped squares photoresist with 60 μm length on Si slot 102A and used as mask to dry etched Si slot with 80 μm thick.

Figure 14A:
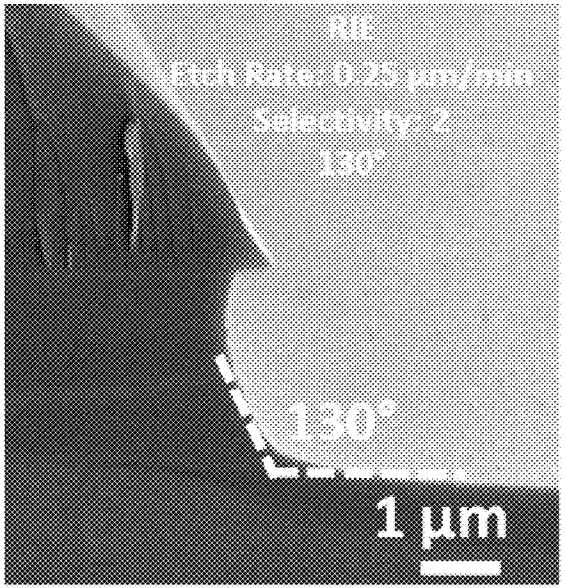
FIGS. 14A to 14C are microscopic images showing profiles of Si patterns etched under different conditions.
Figure 14B:
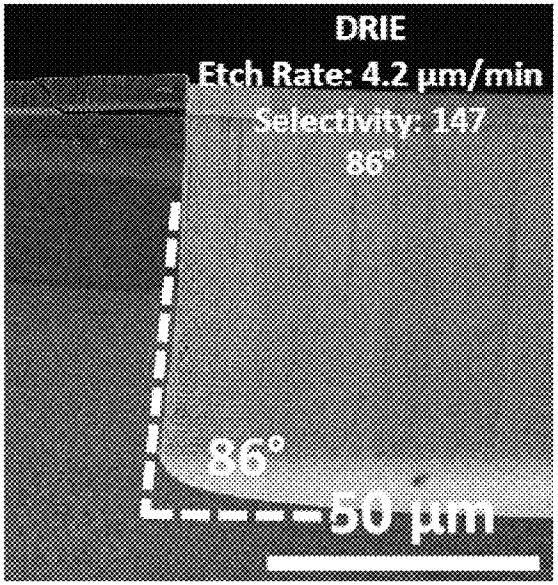
Figure 14C:
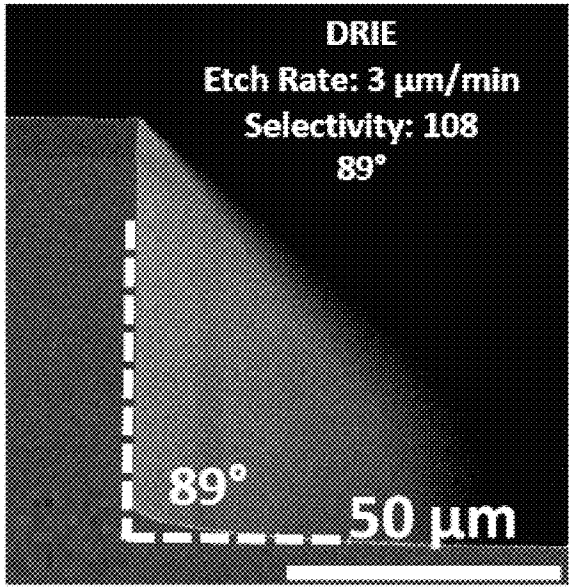

With reference to FIGS. 14A to 14C, it was observable that the metalized Si antenna feed with ME dipole was dry etched by DRIE with high etch rate of 3 μm/min, high selectivity of 108 and good profile of 89° using the optimized etching parameters. For comparison only, with a etch rate of 4.2 μm/min in a DRIE system, the profile was found to be of 86°, and the etch profile of the etched pattern obtained using RIE was 130°.

As appreciated by a person skilled in the art, the above process parameter of the DRIE etching steps may be modified for other possible patterns and/or antenna feed structures. In addition, the antenna feed structures may be fabricated using other approaches, such as but not limited to a bottom-up approach using deposition and stacking of different structures on a substrate of the antenna feed.

The silicon substrate may be further coated with a layer of metal 206 include at least one of Ti, Cu and Au. To finish the fabrication process of the metalized Si antenna feed, at step 1016, the silicon substrate 202 may be deposited with 10/500/20 nm Titanium (Ti)/copper (Cu)/Gold (Au) films 206, such as using evaporation or sputtering. In this example multi-layer structure, Ti may improve adhesion and Au may prevent Cu oxidation. As appreciated by a skilled person in the art, other combination of metal films may be deposited to metalize the antenna feed structure.

Now referring to FIG. 11, there is shown an embodiment of a method of fabricating a resonator 104 for the antenna 100, comprising the steps of: fabricating a first reflector 104A including a curved reflector surface by a imprinting process; disposing a holder structure 104C adjacent to the curved reflector surface; and disposing a second reflector 104B on the holder structure 104C opposite to the first reflector 104A.

Preferably, the open resonator cavity of GBA consist of a metalized SU-8 spherical concave cavity as reflective mirror (the first reflector 104A) and 20 μm thick Si membrane as PRS (the second reflector 104B), and is designed to result a more uniform phase distribution with high directivity, compared to Fabry-Perot cavity antenna with two flat mirrors.

Figure 15:
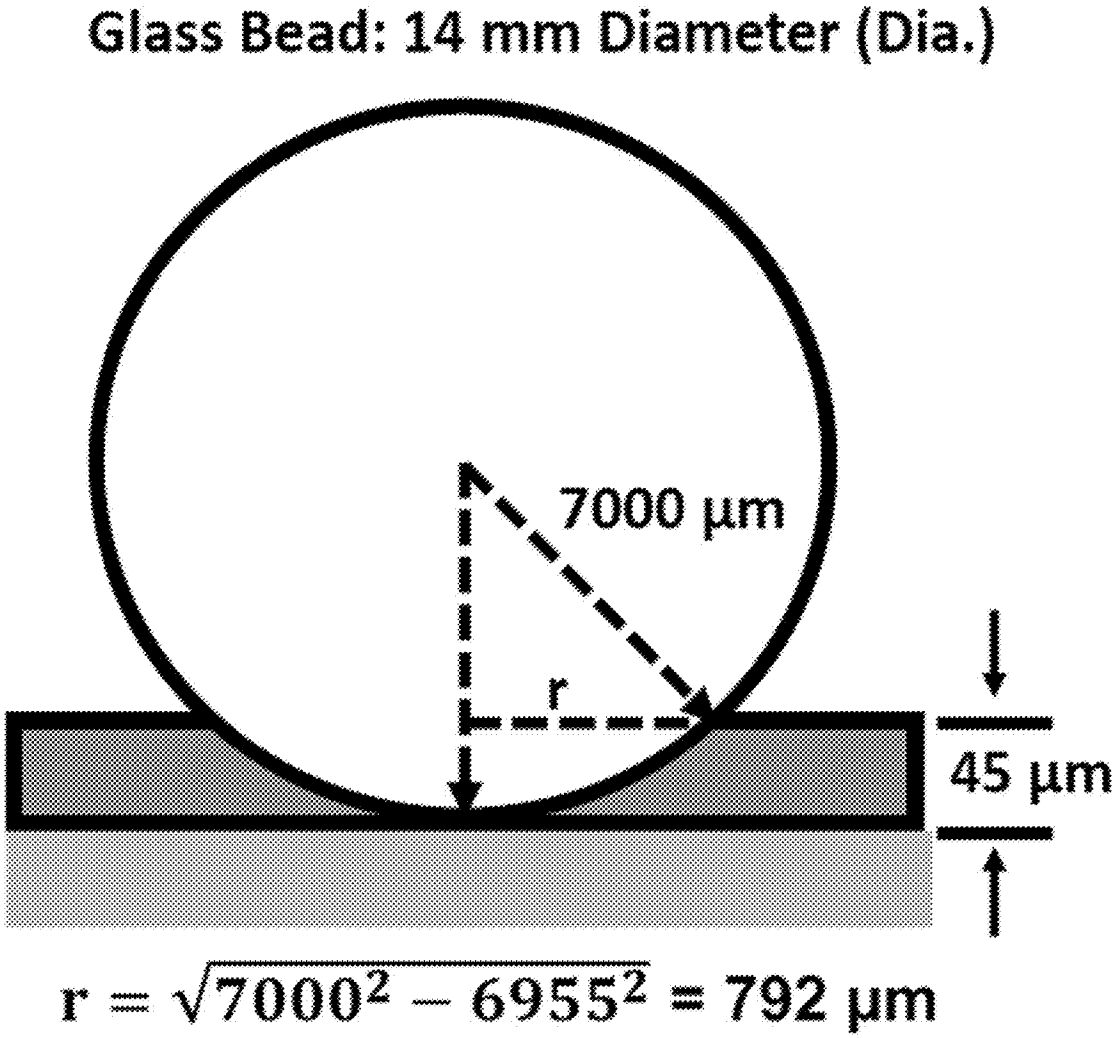
FIG. 15 is an illustration showing a formation of spherical concave cavity by imprinting glass bead with 14 mm diameter into a layer of polymer.
Figure 16A:
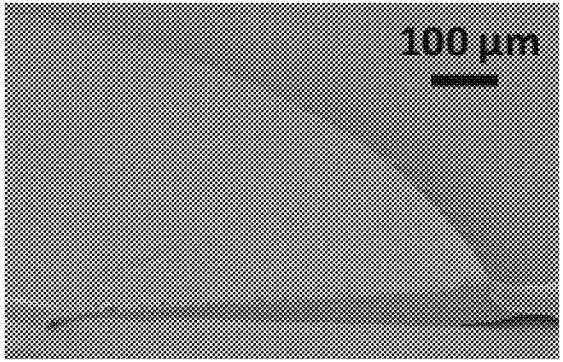
FIGS. 16A to 16F are micrographs of curved cavities with different dimensions due to various initial PDMS and SU-8 thickness.
Figure 16B:
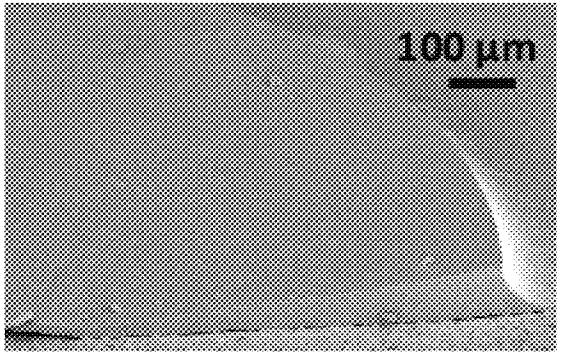
Figure 16C:
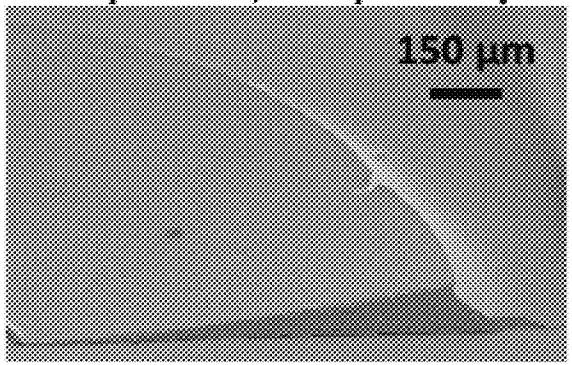
Figure 16D:
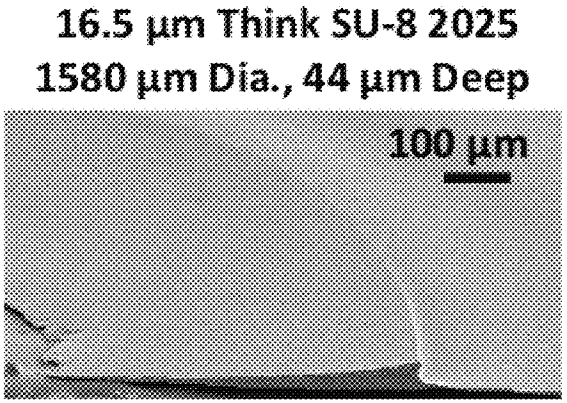
Figure 16E:
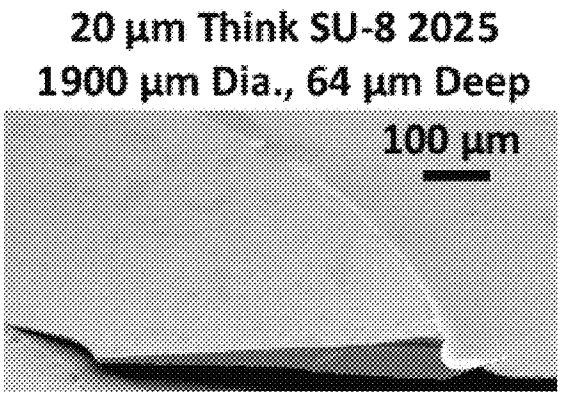
Figure 16F:
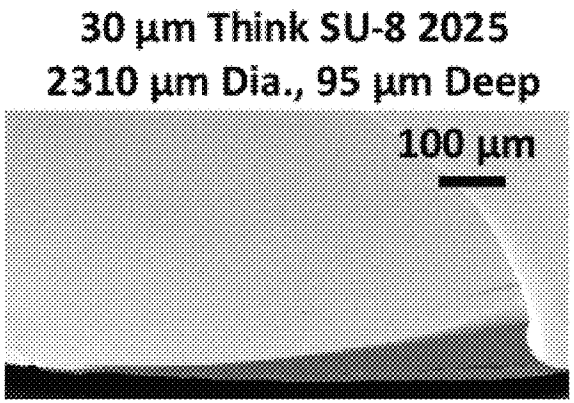

The method 1100 starts by coating a glass substrate 302 with a layer of polymer 304, preferably SU-8 with a thickness of 45 μm at step 1102. Then, at step 1104, a circular mold, such as a glass bead 306 with 14 mm diameter (dia.) may be used to imprint a spherical concave cavity with 1584 μm dia. and a depth of 45 μm. With reference also to FIG. 15, the spherical concave cavity was designed with 1600 μm dia. and a depth of 45 μm.

Preferably, the glass beads 306 with 14 mm diameter may be cleaned with acetone, iso-propanol, and deionized water for 20 min, respectively. After $N_2$ drying, the glass bead 306 may be treated with $O_2$ plasma to make it hydrophilic. Additionally, a surface energy of the glass bead 306 may be reduced by coating the glass bead with trichloro (1H, 1H, 1H, 1H-perfluorooctyil)silane (PFOTS) for easy demolding in the subsequent imprinting process. Other chemicals may also be used for modifying the surface energy of the circular mold.

In the imprinting process at step 1104, the glass bead 306 is imprinted on the layer of polymer 304 deposited on the substrate at low temperature and pressure for a predetermined period of time, and followed by curing of the polymer (at step 1106) to form the curved reflector surface. For example, the SU-8 spherical concave cavity may be imprinted on SU-8 2025 coated glass substrate at 95° C., 5 bar for 10 min and 395 nm ultraviolet (UV) exposure for 60 s. Again, these process parameters may be changed or optimized as appreciated by a skilled person in the art.

With reference to FIGS. 16A to 16D, there is shown a comparison of curved surface formed on SU-8 or PDMS polymer of different thickness. It is observable that SU-8 polymer with initial thickness of 16.5 μm was successful used to achieve the spherical concave cavity with 1584 μm dia., and μm deep. SU-8 polymer also shows more advantages for fabricating spherical concave cavity than PDMS because its young's modulus is $2.6\times10^4$ times higher than PDMS, which prevents polymer deformation and wrinkling.

Figure 17A:
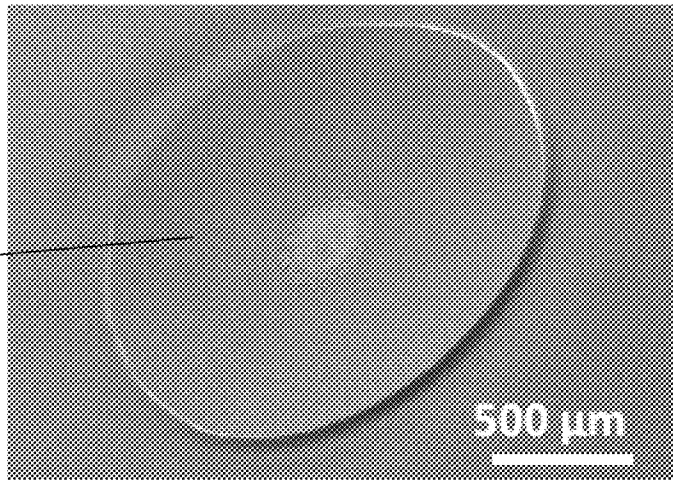
FIGS. 17A to 17D are micrographs of curved cavity after imprint, curved cavity with hole in center and coated with Ti/Cu/Au, curved cavity structure stacked on top of antenna feed and top view of THz resonator antenna with 20 μm thick, 3 mm diameter Si membrane above holder, respectively.

In addition, the SU-8 spherical concave cavity with same initial thickness showed lower dia. and deep than PDMS spherical concave cavity due to its higher viscosity (3500 centipoise for PDMS mixed at 10:1 curing ratio vs. 5484 centipoise for SU-8 2025). SU-8 also has a better UV crosslinking property when compared to PDMS. Referring to FIG. 17A, there is shown an image of the SU-8 Curved gain Structure after the imprinting process.

In some alternative embodiments, other types and thicknesses of polymers may be employed according to different design requirements of the curved reflector and imprinting process parameters being used. In addition, the imprinting stamp may also be of other materials and shape as appreciated in the person skilled in imprinting technologies.

An aperture 308 may be defined at a center position of the curved reflector surface, by cutting through the layer of polymer 304, so as to expose the antenna feed 102 to the resonating cavity 106. At step 1108, a 450 μm aperture 308 may be formed by drilling, at the center of SU-8 spherical concave cavity 310, using a femtosecond laser with 350 μW power.

Figure 17B:
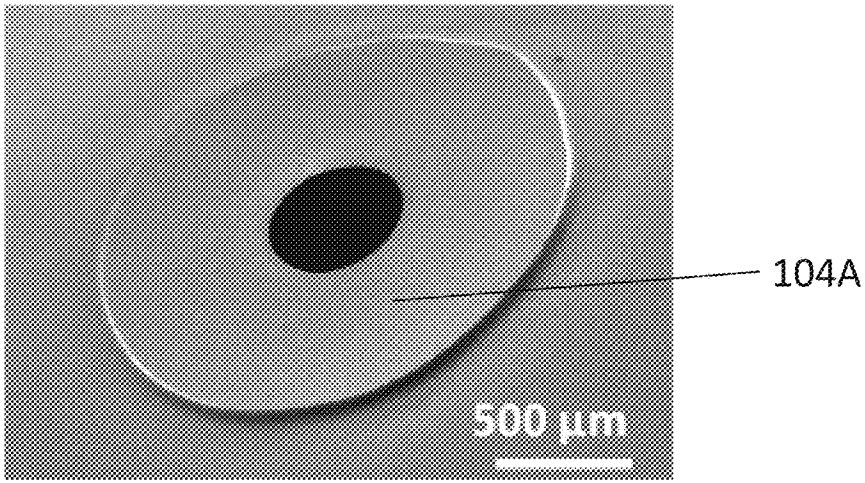

A layer of reflective material 312, such as metal including Ti, Cu and/or Au, may be deposited on the curved reflective surface 310 to the form the first reflector 104A of the resonator 104. At step 1110, the SU-8 spherical concave cavity with the 450 μm hole 308 may be metalized by coating 10/500/20 nm Titanium (Ti)/copper (Cu)/Gold (Au) films using sputtering system. The metalized SU-8 spherical concave cavity may be peeled off from glass substrate 302, also shown in the image of FIG. 17B.

Figure 17C:
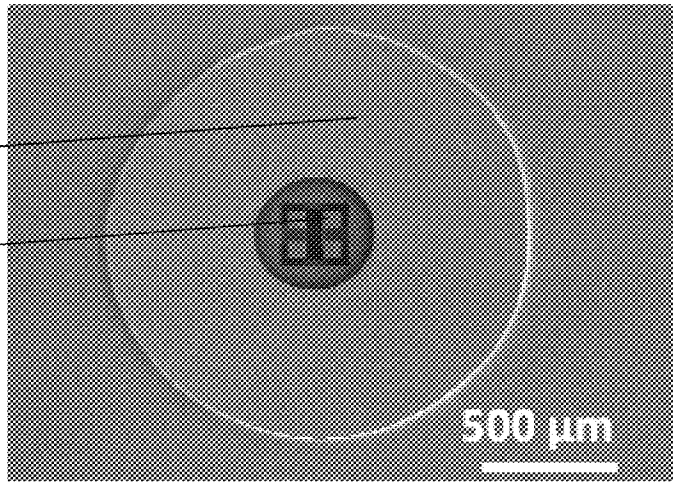

The antenna feed 102 may be positioned at the center position of the curved reflector surface, in which the antenna feed 102 fabricated using method 1000 is exposed to the curved reflector surface. At step 1112, the antenna feed 102 may be aligned on top of the metalized Si antenna feed under long working distance microscopy. The aligned antenna and first reflector is illustrated in the image of FIG. 17C.

At step 1114, a cylindrical holder structure 104C, which may be easily fabricated using 3D printing, may be placed on the first reflector 104A, aligning (concentrically) with the curved reflector surface and the antenna feed 102. Alternatively or additionally, other techniques such as machining and/or etching of a bulk material to form the required holder structure may also be applied.

Figure 17D:
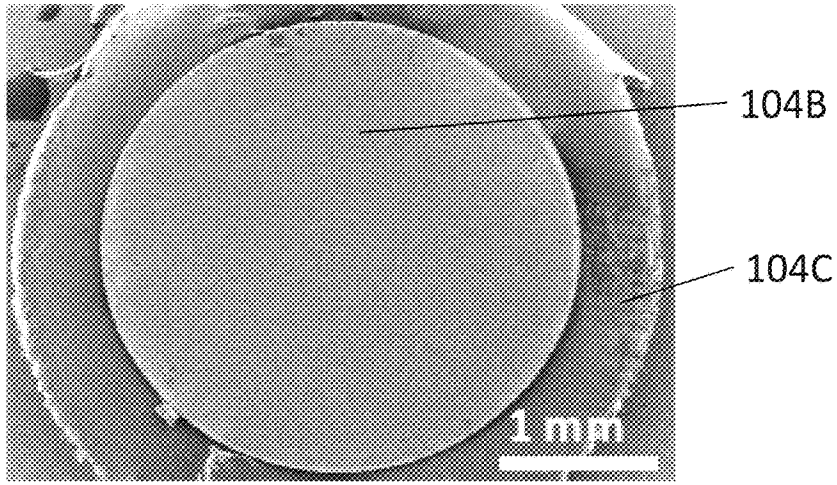

Finally, at step 1116, the metalized SU-8 spherical concave cavity may be completed by including a PRS of a 20 μm thick (undoped) Si membrane 104B at the opposite side of the first reflector 104A. Preferably, the Si membrane 104B may be adhered to the holder structure 104C by using thin layer of SU-8 polymer at 80° C. for 1 min and then cross-linked by UV exposure at 20° C. for 1 min. A top view of the fabricated antenna is shown in FIG. 17D.

With reference to FIGS. 18A to 18D, the roughness of Ti/Cu/Au films on SU-8 and Si are 1.94 and 1.2 nm, respectively, the roughness of pure Si surface was 0.29 nm for double side polished Si wafer, and 0.35 nm on the surface of a layer of SU-8 coated on the wafer.

Figure 19B:
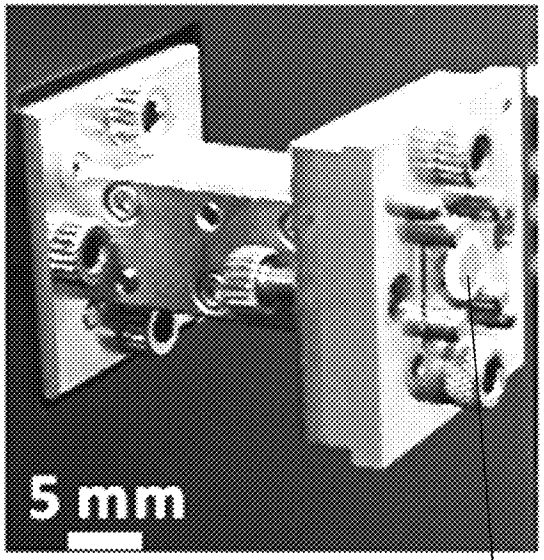
FIGS. 19A and 19B are images showing the THz antenna measurement system used for evaluating the performances of the antenna fabricated in accordance with embodiments of the present invention.
Figure 19A:
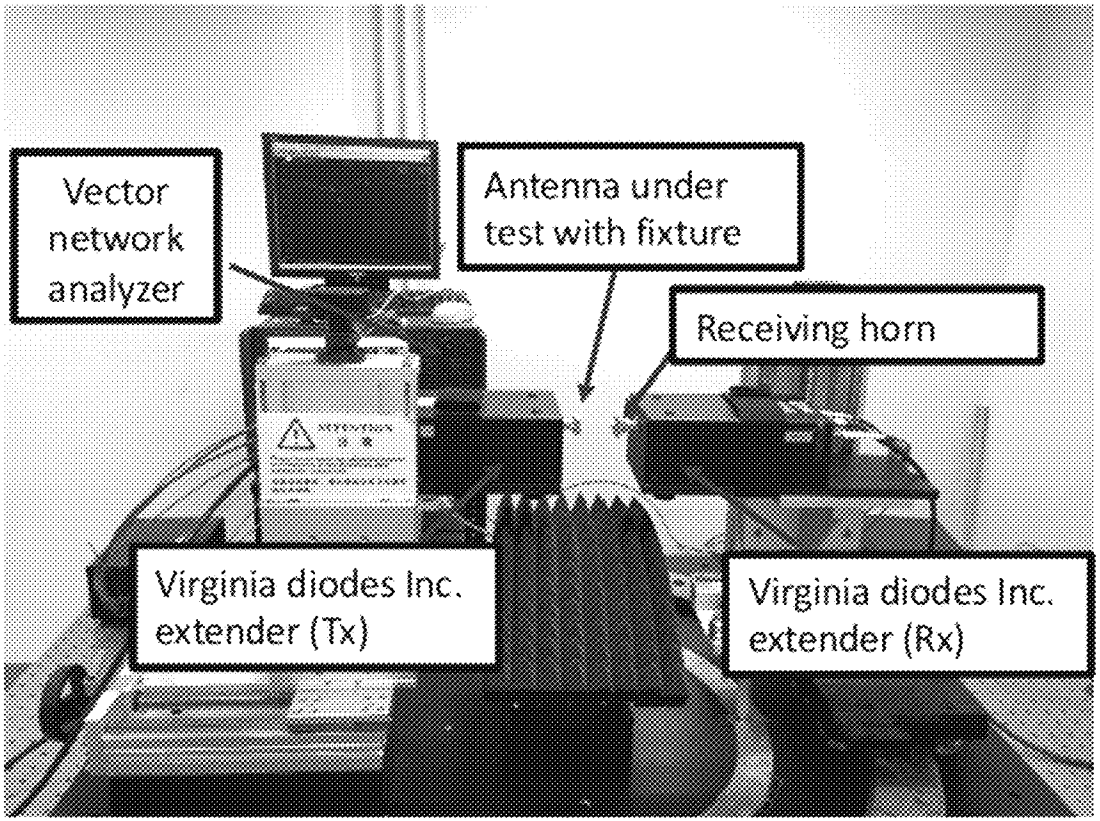

The inventor also evaluated the as fabricated antenna in accordance with embodiments of the present invention using a network analyzer. With reference to FIG. 19A, the THz GBA was measured by an in-house far-field THz measurement system 1900 consists of a vector network analyzer (VNA), a pair of Virginia Diodes Inc. (VDI) extenders, a monitor, and a manual mechanical rotational stage. Referring to FIG. 19B, the THz GBA was fixed on VDI extender with a fixture.

Figure 20:
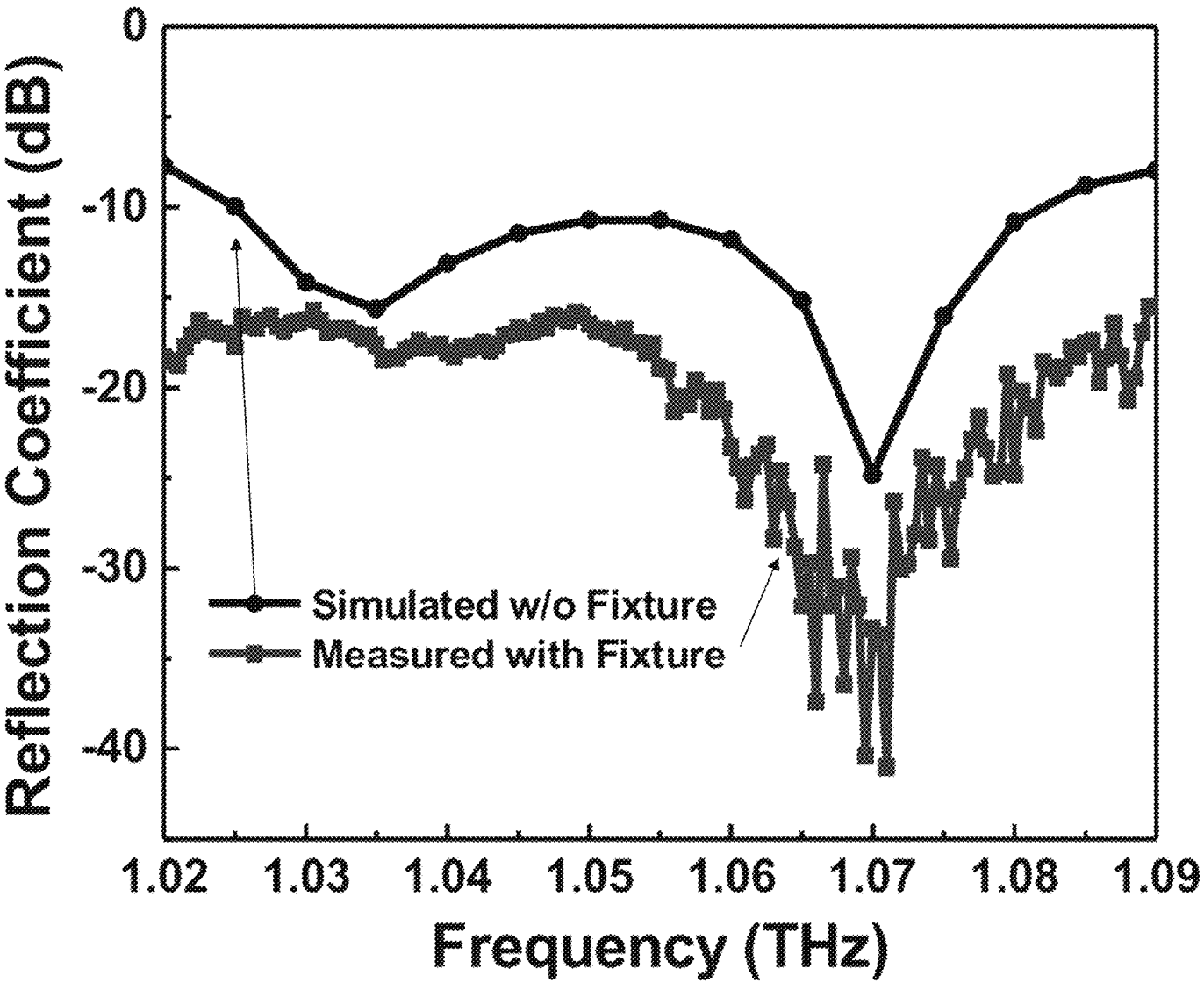
FIG. 20 is a plot showing simulated and measured reflection coefficient of THz GBA with spherical Fabry-Perot cavity.

With reference to the plot as shown in FIG. 20, the simulated $S_{11}$ of THz GBA was below −10 dB from 1.02 to 1.08 THz and the measured Sit was 5 dB lower due to the extra energy loss caused by the bulky fixture and the transition structure between $T_x$ module and the GBA. A trend of measured $S_{11}$ corresponded with the simulated result of THz GBA is also observable.

Figure 21:
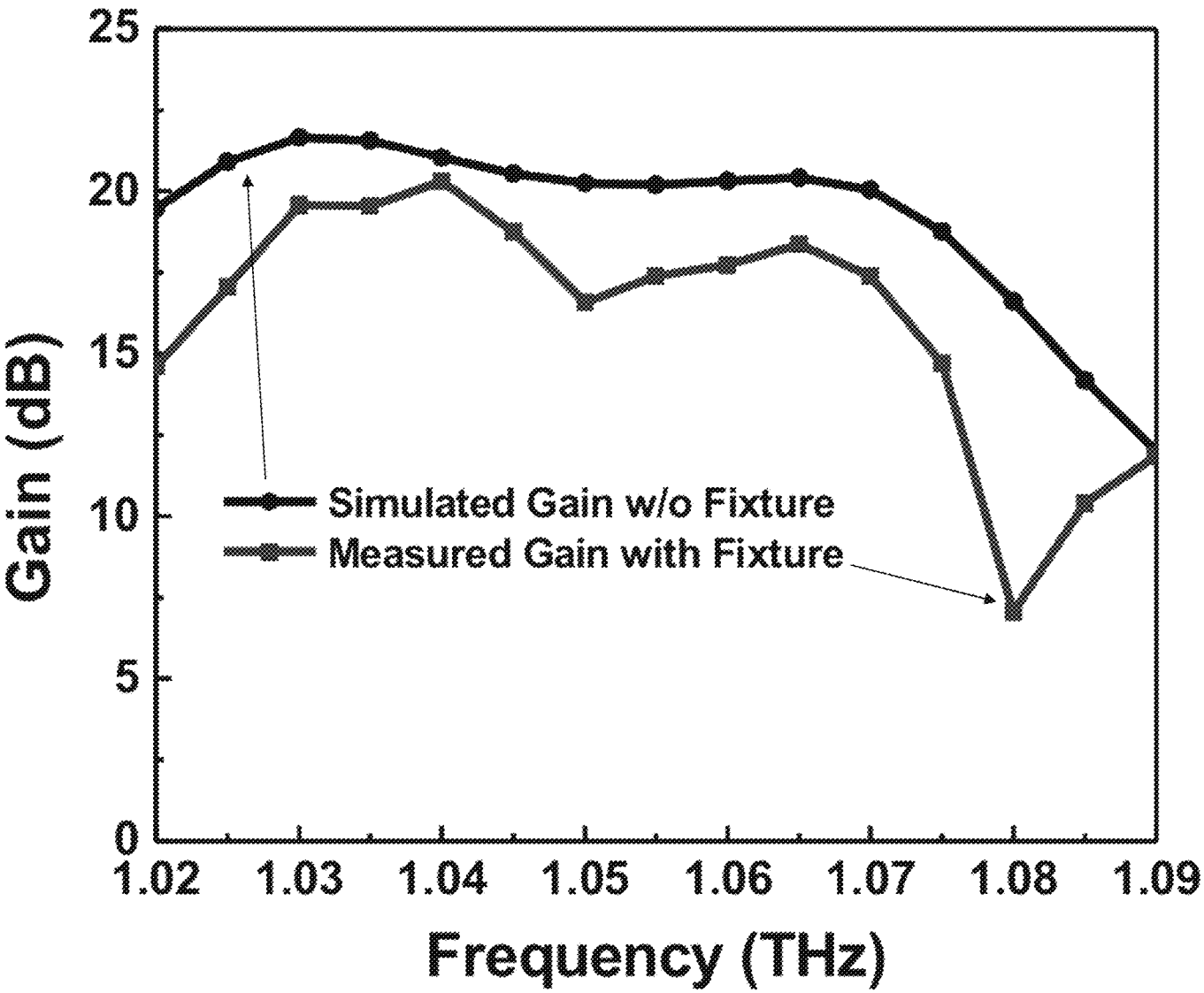
FIG. 21 is a plot showing simulated and measured gain of THz GBA with spherical Fabry-Perot cavity.

With reference to FIG. 21, the measured gain of THz GBA was 20.3 dBi at 1.04 THz and the measured 3-dB bandwidth of H plane and E plane was ~12°. The radiation efficiency of THz GBA was calculated to be 73% at 1.04 THz.

Figure 22A:
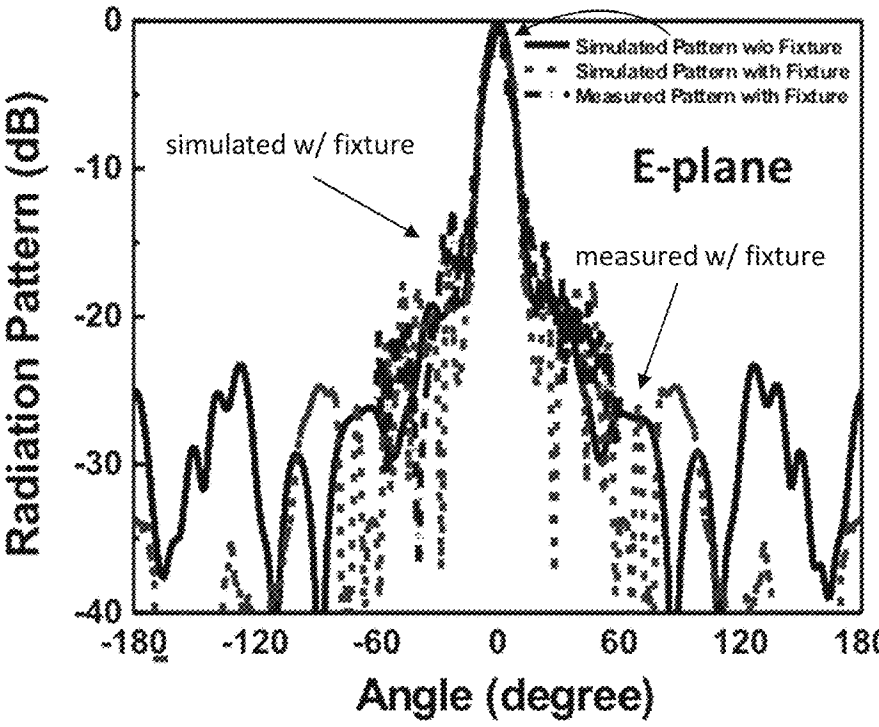
FIGS. 22A and 22B are plots showing simulated and measured radiation pattern at E-plane and H-plane for the THz GBA with spherical Fabry-Perot cavity.
Figure 22B:
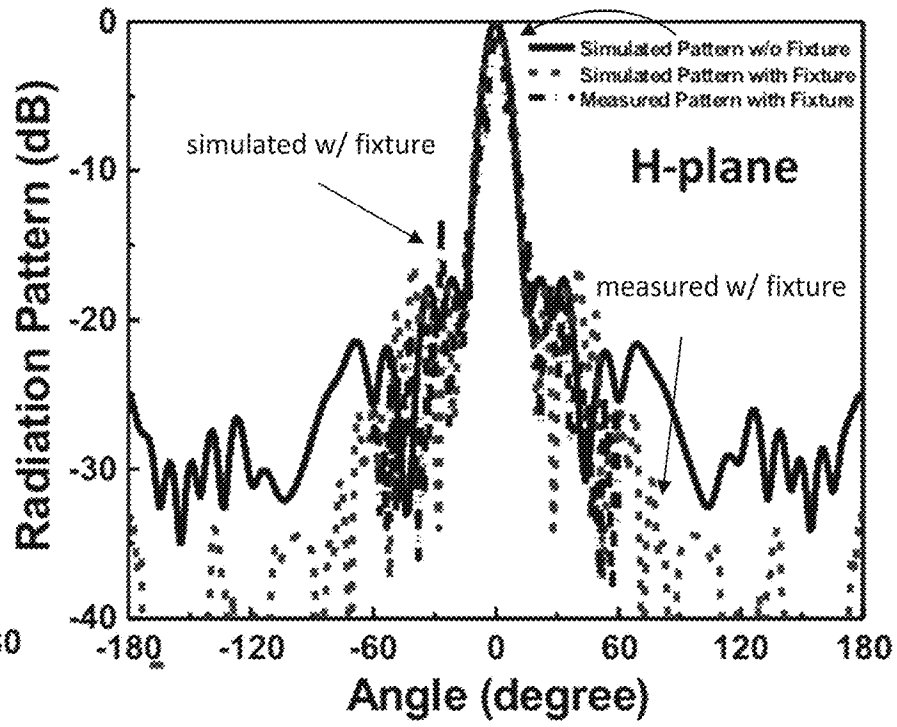

With reference to FIG. 22, the measured main beam of THz GBA in E-plane and H-plane matched well with simulation results, indicating that a highly directivity radiation was achieved by the THz antenna in the present invention.

These embodiments may be advantageous in that, THz GBA may be fabricated using a fast, high accurate and low cost fabrication process, which is compatible to a Si-based microfabrication process.

According to the method used in the present invention, the surface roughness of THz GBA may be as low as a few nanometers. In addition, the performance of the antenna may achieve a high gain of 20.3 dBi at 1.04 THz. The measured radiation results also proved that the THz GBA maintained a highly directive radiation.

Advantageously, the THz GBA can be used to transmit and receive radio waves at 1 THz in compact communication systems. With highly directive radiation, the THz communication system with THz GBA may be transmitted through a longer communication distance. Such high-gain low-profile THz GBA can be used in 6G THz communication, such as but not limited to, short-distance high-data-rate communication, as well as other possible applications in the 10 to 100 THz ranges.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. An antenna comprising:

an antenna feed arranged to emit an electromagnetic signal along a predetermined direction;

a resonator disposed adjacent to the antenna feed arranged to improve a directivity of the electromagnetic signal being emitted by the antenna feed;

wherein the resonator includes a first reflector and a second reflector sandwiching a resonating cavity therebetween; and wherein the first reflector includes a curved reflector surface; said antenna feed positioned at the curved reflector surface, at a center position thereof.

2. The antenna in accordance with claim 1, wherein the curved reflector surface of the first reflector is defined with an aperture at the center position of the curved reflector surface so as to expose the antenna feed to the resonating cavity.

3. The antenna in accordance with claim 1, wherein the first reflector includes a layer reflective material on the curved reflector surface.

4. The antenna in accordance with claim 3, wherein the reflective material includes Ti, Cu and/or Au.

5. The antenna in accordance with claim 1, wherein the curved reflector surface is formed on a concave pattern defined on a layer of soft material.

6. The antenna in accordance with claim 5, wherein the concave pattern is formed by an imprinting process.

7. The antenna in accordance with claim 6, wherein the concave pattern is formed by imprinting with a circular mold on the layer of soft material deposited on a substrate of the first reflector.

8. The antenna in accordance with claim 5, wherein the soft material includes SU-8 and/or a polymer.

9. The antenna in accordance with claim 1, wherein the second reflector includes a partial reflected surface.

10. The antenna in accordance with claim 9, wherein the second reflector is a membrane including at least silicon.

11. The antenna in accordance with claim 10, wherein the membrane includes a thickness of 20 μm.

12. The antenna in accordance with claim 1, wherein the resonator further includes a holder structure disposed adjacent to the curved reflector surface of the first reflector, and the holder structure supports the second reflector opposite to the first reflector.

13. The antenna in accordance with claim 12, wherein the second reflector, the holder structure and/or the resonating cavity are cylindrical in shape.

14. The antenna in accordance with claim 12, wherein the holder structure is formed by 3D printing.

15. The antenna in accordance with claim 1, wherein the resonator is further arranged to support high order Laguerre-Gaussian beam modes of the electromagnetic signal.

16. The antenna in accordance with claim 1, wherein the antenna feed includes a magneto-electric dipole.

17. The antenna in accordance with claim 1, wherein the antenna feed is a metalized structure.

18. The antenna in accordance with claim 17, wherein the antenna feed includes a slot and a plurality of pillar structures formed on a substrate.

19. The antenna in accordance with claim 18, wherein the substrate is coated with a layer of metal include at least one of Ti, Cu and/or Au.

20. The antenna in accordance with claim 1, wherein the antenna is operable as a Gaussian beam antenna.

21. The antenna in accordance with claim 1, wherein a combination of the antenna feed and the resonator includes a thickness smaller than three times of a wavelength of the electromagnetic signal emitted by the antenna feed.

22. A method of fabricating a resonator for an antenna, comprising the steps of:

fabricating a first reflector including a curved reflector surface;

disposing a holder structure adjacent to the curved reflector surface; and disposing a second reflector on the holder structure opposite to the first reflector;

wherein the first reflector and the second reflector sandwiches a resonating cavity therebetween;

wherein the resonator is arranged to improve a directivity of the electromagnetic signal being emitted by an antenna feed of the antenna including the resonator; and wherein the curved reflector surface is adapted to attach with the antenna feed at a center position of the curved reflector surface.

23. The method in accordance with claim 22, wherein the step of fabricating the first reflector comprises the step of imprinting with a circular mold on a layer of soft material deposited on a substrate of the first reflector.

24. The method in accordance with claim 23, wherein in the imprinting process, the circular mold is imprinted on the layer of soft material deposited on the substrate at low temperature and pressure for a predetermined period of time, and followed by curing of the soft material to form the curved reflector surface.

25. The method in accordance with claim 23, wherein the step of imprinting with a circular mold on the layer of soft material deposited on the substrate of the first reflector comprises the step of reducing a surface energy of the circular mold by coating the circular mold with at least trichloro(1H, 1H, 1H, 1H-perfluorooctyil)silane to modify surface energy.

26. The method in accordance with claim 22, wherein the step of fabricating the first reflector comprises the step of coating the curved reflector surface with a layer reflective material.

27. The method in accordance with claim 26, wherein the reflective material includes Ti, Cu and/or Au.

28. The method in accordance with claim 22, wherein the step of fabricating the first reflector comprises the step of defining an aperture at a center position of the curved reflector surface so as to expose the antenna feed to the resonating cavity.

29. The method in accordance with claim 28, wherein the step of defining an aperture at the center position of the curved reflector surface comprises the step of cutting through the layer of soft material to form the aperture on the first reflector.

30. The method in accordance with claim 28, wherein the antenna feed is positioned at the center position of the curved reflector surface.

31. The method in accordance with claim 22, further comprising the step of fabricating the holder structure using 3D printing.

32. The method in accordance with claim 22, wherein the disposing a second reflector on the holder structure comprising the step of adhering a membrane on the holder.

33. A method of fabricating an antenna, comprising the steps of:—fabricating an antenna feed on a substrate; and—combining the antenna feed with at least a part of the resonator fabricated using the method in accordance with claim 28; wherein the resonator is disposed adjacent to the antenna feed.

34. The method in accordance with claim 33, wherein the step of fabricating the antenna feed comprises the step of etching the substrate to define a slot and a plurality of pillar structures on the substrate.

35. The method in accordance with claim 34, wherein the substrate is processed by deep reactive ion etching.

36. The method in accordance with claim 33, further comprising the step of coating the substrate with a layer of metal include Ti, Cu and/or Au.

37. The method in accordance with claim 33, wherein the antenna feed is combined with the first reflector of the resonator.

38. An antenna comprising:

an antenna feed arranged to emit an electromagnetic signal along a predetermined direction;

a resonator disposed adjacent to the antenna feed arranged to improve a directivity of the electromagnetic signal being emitted by the antenna feed;

wherein the resonator includes a first reflector and a second reflector sandwiching a resonating cavity therebetween; the first reflector comprises a curved reflector surface;

wherein the second reflector comprises a partial reflected surface which is adapted to partially reflect the electromagnetic signal emitted by the antenna feed towards the curved reflector surface.

* * * * *